US012704057B2

(12) United States Patent
Whitlow et al.

(10) Patent No.: US 12,704,057 B2
(45) Date of Patent: Aug. 11, 2026

(54) SYSTEMS AND METHODS FOR REGULATING WEIGHT ON BIT (WOB)

(71) Applicant: HELMERICH & PAYNE TECHNOLOGIES, LLC, Tulsa, OK (US)

(72) Inventors: Zackary William Whitlow, Denver, CO (US); Alexander Michael Mitkus, Denver, CO (US)

(73) Assignee: HELMERICH & PAYNE TECHNOLOGIES, LLC, Tulsa, OK (US)

( * ) Notice: Subject to any disclaimer, the term of this patent is extended or adjusted under 35 U.S.C. 154(b) by 338 days.

(21) Appl. No.: 18/045,364

(22) Filed: Oct. 10, 2022

(65) Prior Publication Data

US 2023/0114148 A1 Apr. 13, 2023

Related U.S. Application Data

(60) Provisional application No. 63/262,305, filed on Oct. 8, 2021.

(51) Int. Cl.
*E21B 44/04* (2006.01)
*E21B 21/08* (2006.01)

(52) U.S. Cl.
CPC ..... *E21B 44/04* (2013.01); *E21B 21/08* (2013.01); *E21B 2200/20* (2020.05)

(58) Field of Classification Search
CPC ..... E21B 44/00; E21B 44/02; E21B 44/04; E21B 47/00; E21B 2200/20
See application file for complete search history.

(56) References Cited

U.S. PATENT DOCUMENTS

| | | | | |
|---|---|---|---|---|
| 10,876,390 | B1 | 12/2020 | Scotvold et al. | |
| 10,957,177 | B2 | 3/2021 | Michalopulos et al. | |
| 10,982,950 | B2 | 4/2021 | Torrione | |
| 2015/0322767 | A1* | 11/2015 | Samuel | E21B 10/26 175/27 |
| 2016/0130889 | A1 | 5/2016 | Torrione | |
| 2018/0238162 | A1* | 8/2018 | Jeffryes | G01L 25/00 |

* cited by examiner

*Primary Examiner* — Tara Schimpf
*Assistant Examiner* — Lamia Quaim
(74) *Attorney, Agent, or Firm* — Kilpatrick Townsend & Stockton LLP

(57) ABSTRACT

Systems and methods for regulating weight-on-bit (WOB). Systems and methods for regulating WOB may monitor and change the rate of penetration (ROP) or may maintain the ROP within a target range therefor. The methods for regulating WOB may include characterizing an average force profile, determining whether force profile disturbances occur at similar well elevator position, receiving data stream of hook load and elevator positions, and applying a force correction to the hook load during tool joint passing events. Systems and methods for regulating WOB may receive force profile data and sensor measurements including WOB, torque, and differential pressure for a current position of the tool joint and provide an adjustment to the ROP or maintain an ROP when the tooljoint passes through the rotating head.

16 Claims, 27 Drawing Sheets

SYSTEMS AND METHODS FOR REGULATING WEIGHT ON BIT (WOB)

CROSS-REFERENCES TO RELATED APPLICATIONS

This application claims the benefit of U.S. Provisional Patent Application No. 63/262,305, filed Oct. 8, 2021, which is hereby incorporated by reference in its entirety and for all purposes.

BACKGROUND

Field of the Disclosure

The present disclosure relates generally to drilling of wells for oil and gas production and, more particularly, to systems and methods for maintaining a smooth rate of penetration while controlling hookload or surface weight-on-bit (SWOB). SWOB can be defined as the weight on bit estimated by the difference between zeroed hookload and current hookload.

Description of the Related Art

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling and may not be capable of gathering and processing various information from downhole sensors and surface control systems in a timely manner, in order to improve drilling operations and minimize drilling errors.

The determination of the well trajectory from a downhole survey may involve various calculations that depend upon reference values and measured values. However, various internal and external factors may adversely affect the downhole survey and, in turn, the determination of the well trajectory.

In an exemplary drilling system, a drill string can include multiple sections of drill pipe. The sections of drill pipe are connected via tool joints which can have a larger outside diameter than the rest of the pipe. When the tool joints pass through the rotating head (i.e., the seal at the top of the annulus), there is increased friction. This increased friction is often interpreted as increased weight on bit which, when regulating weight on bit, can lead to far lower than necessary drilling speed which can result in lost productivity for the drilling rig and bit damage.

BRIEF SUMMARY

Certain embodiments of the present disclosure can provide methods, systems, and apparatuses for regulating weight on bit for drill rig systems.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In one general aspect, a process may include monitoring, by a computer system surface weight on bit (SWOB) when a tooljoint passes through a rotating head of a drilling rig. The process may in addition include generating, by the computer system, a force profile responsive to the tooljoint passing through the rotating head. Responsive to the force profile, the process may also include determining, by the computer system, if SWOB during drilling exceeds a threshold value therefor. The process may further include adjusting one or more drilling operations to reduce WOB when the SWOB exceeds the threshold therefor. Other embodiments of this aspect can include corresponding computer systems, apparatus, and computer programs recorded on one or more computer storage devices, each configured to perform the actions of the process.

Implementations may include one or more of the following features. The process may include the step of continuing drilling operations when the SWOB does not exceed the threshold therefor. In various embodiments, the force profile may include an average force profile expressed as SWOB relative to an unit length. In various embodiments, the force profile may include an average value of a plurality of SWOB values. The plurality of SWOB values may include SWOB values associated with a plurality of tooljoints passing one of a plurality of rotating heads of a drilling rig obtained from a previously drilled well. The process may include the step of monitoring, by the computer system, a block height value associated with each of the SWOB values. The process may include determining, by a computer system, whether a block height or block height range is associated with one or more feature points of the force profile. The process may include determining, by a computer system and responsive to the block height or block height range, an actual hook load value for the drill string. The process may include using the actual hook load value to control one or more drilling operations. In various embodiments the control of one or more drilling operations may include maintaining a rate of penetration (ROP) within a target range therefor while one or more tooljoints pass through the rotating head. In various embodiments, the control of one or more drilling operations may include maintaining a SWOB within a target range therefor while one or more tooljoints pass through the rotating head. Implementations of the described techniques may include hardware, a process or process, or a computer tangible medium to perform the process described above.

In one general aspect, a control system may include a processor, and a memory coupled to the processor. The memory may include instructions when executed by the processor for monitoring estimated weight on bit (SWOB) during drilling of a well perform operations. The operations can include determining if an increase in SWOB may include a transient WOB increase. The operations can include sending one or more control signals to one or more control systems coupled to a drilling rig to adjust one or more drilling operation parameters if the SWOB increase is determined to be larger than expected due to friction between tooljoint and rotating head interaction; and maintaining rate of penetration (ROP) if the SWOB increase is determined to be within the range expected due to tooljoint rotating head interaction. Other embodiments of this aspect include corresponding computer systems, apparatus, and computer programs recorded on one or more computer storage devices, each configured to perform the actions of the process described above.

In one general aspect, a non-transitory computer-readable storage medium may include monitoring, by a computer system surface weight on bit (SWOB) when a tooljoint passes through a rotating head of a drilling rig. The non-transitory computer-readable storage medium may perform operations to include generating, by the computer system, a force profile responsive to the tooljoint passing through the rotating head. The operations may also include responsive to the force profile, determining, by the computer system, if SWOB during drilling exceeds a threshold value therefor. The operations may further include adjusting one or more drilling operations to reduce WOB when the SWOB exceeds the threshold therefor. Other embodiments of this aspect include corresponding computer systems, apparatus, and computer programs recorded on one or more computer storage devices, each configured to perform the actions of the process described above.

Implementations may include one or more of the following features. In various embodiments, determining an actual hook load value may include determining whether a block height or block height range is associated with one or more features of the force profile. A Non-transitory computer-readable storage medium may include instructions for performing the step of continuing drilling operations when the SWOB does not exceed the threshold therefor. In various embodiments, the force profile may include an average force profile expressed as SWOB relative to a unit length. In various embodiments, the force profile may include an average value of a plurality of SWOB values. In various embodiments, the plurality of SWOB values may include SWOB values associated with a plurality of tooljoints passing one of a plurality of rotating heads of a drilling rig obtained from a previously drilled well. The non-transitory computer-readable storage medium may include instructions for performing the step of monitoring, by the computer system, a block height value associated with each of the SWOB values In various embodiments, the process may include calibrating a position of a traveling block when the tool joints reach a rotating head. The process may include adding an average force profile to SWOB at the calibrated position. The process may include adding a weight profile into a control process to determine a hook load when some of the weight is not being held up by a rotating head. In various embodiments, the process may include determining a mean block velocity. When the tool joint passing event is detected, the process can include adjust the maximum rate of penetration to the mean block velocity. Implementations of the described techniques may include hardware, a process or process, or a computer tangible medium.

In some aspects, a method of regulating WOB for drilling operations can include determining an average force profile for a plurality of tool joint passing events. The method can include determining whether a tool joint passing event occurs at a same position with respect to an elevator position based at least in part on the average force profile. The method can include receiving a data stream of hookload values and corresponding elevator positions. When a tool joint passing event is assumed based on calibration or detected based on feedback indicating pipe diameter at the rotating head, the method can include applying a force correction to the hookload during the tool joint passing event.

In various embodiments, the method can include updating the average force profile for a plurality of wells.

In various embodiments, the method can include providing for a resulting drop in the autodriller ROP upper limit to less than a predetermined rate set by the driller.

In various embodiments, the method can include calibrating a position of a traveling block when the tool joints reach a rotating head.

In various embodiments, computer vision system can be used to determine tool joint positions relative to the rotating head.

In various embodiments, the method can include adding an average force profile to surface weight-on-bit at the calibrated position.

In various embodiments, the method can include adding a weight profile into a control process to determine a hook load when some of the weight is not being held up by a rotating head.

In various embodiments, the method can include determining a mean block velocity. When the tool joint passing event is detected, the method can include adjustment of the autodriller ROP upper limit to the mean block velocity.

In an aspect, a controller device, can include a memory comprising computer-executable instructions; and one or more processors in communication with the memory and configured to access the memory and execute the computer-executable instructions to perform any one or more of the methods described above.

In an aspect, one or more non-transitory computer-readable storage medium comprising computer-executable instructions that, when executed by one or more processors, cause the one or more processors to perform any or more of the methods described above.

Reference to the remaining portions of the specification, including the drawings and claims, will realize other features and advantages of embodiments of the present disclosure. Further features and advantages, as well as the structure and operation of various embodiments of the present disclosure, are described in detail below with respect to the accompanying drawings. In the drawings, like reference numbers can indicate identical or functionally similar elements.

BRIEF DESCRIPTION OF THE DRAWINGS

For a more complete understanding of the present invention and its features and advantages, reference is now made to the following description, taken in conjunction with the accompanying drawings, in which:

FIG. 14A illustrates WOB change profile data from a plurality of exemplary wells for non-aligned features;

FIG. 14B illustrates WOB change profile data from a plurality of exemplary wells for Xcorr aligned features;

FIG. 14C illustrates and average plot of WOB change profile data from a plurality of exemplary wells for Xcorr aligned features;

FIG. 20 illustrates that a constant ROP is achieved when running the physical tooljoint model with the correction, according to various embodiments;

FIG. 21 illustrates that the physical tooljoint model (e.g., the simulation) appropriately reacts when rock hardness increases during tooljoint passing, according to various embodiments;

FIG. 22 illustrates that the open loop (ROP regulation) behavior remains the same, according to various embodiments;

FIG. 23 illustrates that the physical tooljoint model (e.g., the simulation) appropriately reacts when set point drop moves WOB-regulation to open-loop, according to various embodiments;

FIG. 24 illustrates that when in open-loop mode, the ROP set point is increased during event, according to various embodiments; and FIG. 25 illustrates an exemplary simulation case where calibration is off, and the correction is applied while not physically passing tooljoint.

DETAILED DESCRIPTION OF PARTICULAR EMBODIMENT(S)

Figure 1:
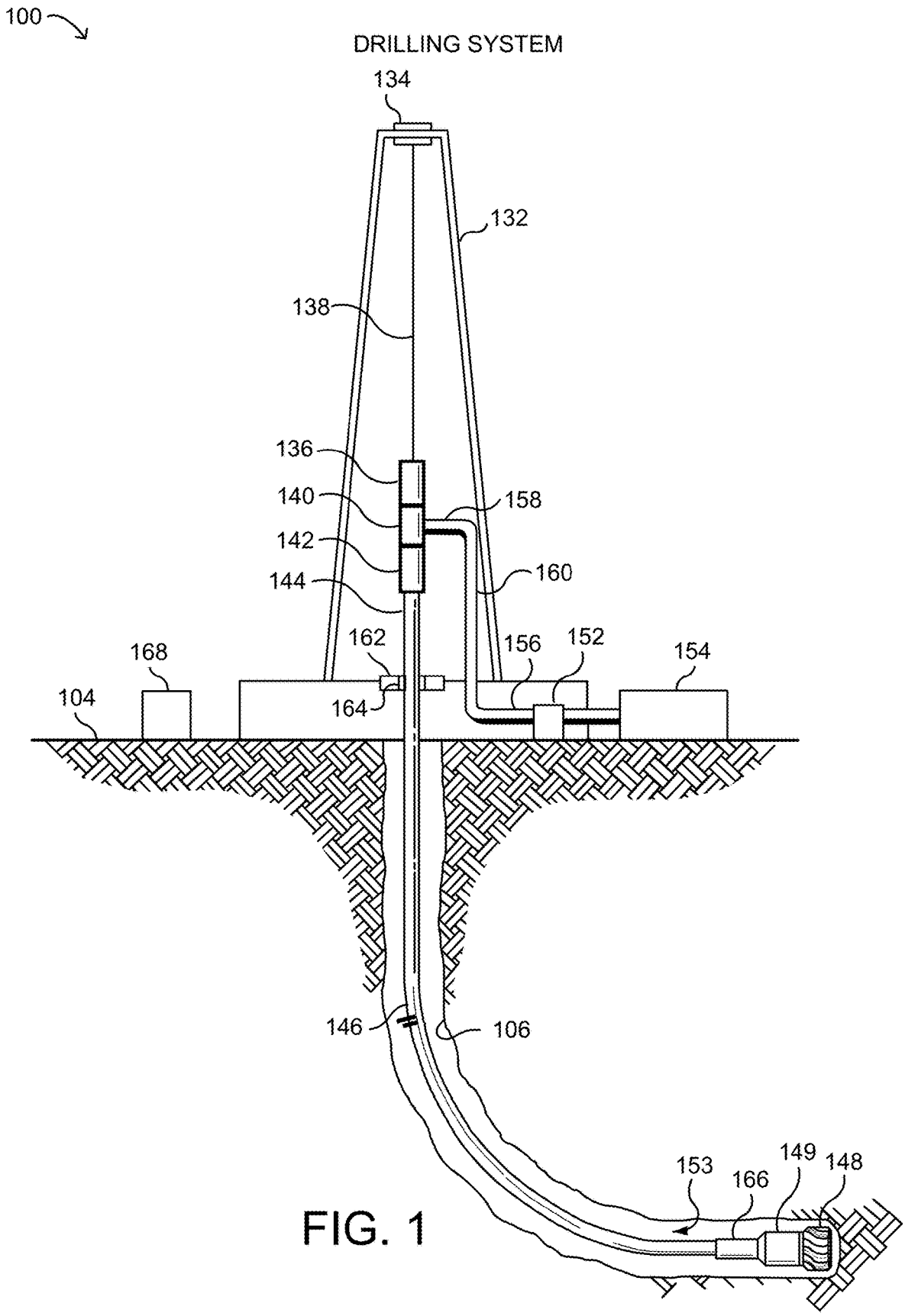
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture (e.g., drilling mud 153) from a mud pit 154 into drill string 146. Mud pit 154 is shown schematically as a container, but it is noted that various receptacles, tanks, pits, or other containers may be used. Drilling mud 153 may flow from mud pump 152 into a discharge line 156 that is coupled to a rotary hose 158 by a standpipe 160. Rotary hose 158 may then be coupled to top drive 140, which includes a passage for drilling mud 153 to flow into borehole 106 via drill string 146 from where drilling mud 153 may emerge at drill bit 148. Drilling mud 153 may lubricate drill bit 148 during drilling and, due to the pressure supplied by mud pump 152, drilling mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using certain methods and systems for improved drilling performance.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, which is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a drill plan, a regional formation history, drilling engineer parameters, downhole toolface/inclination information, downhole tool gamma/resistivity information, economic parameters, and reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the drill plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168.

Figure 2:
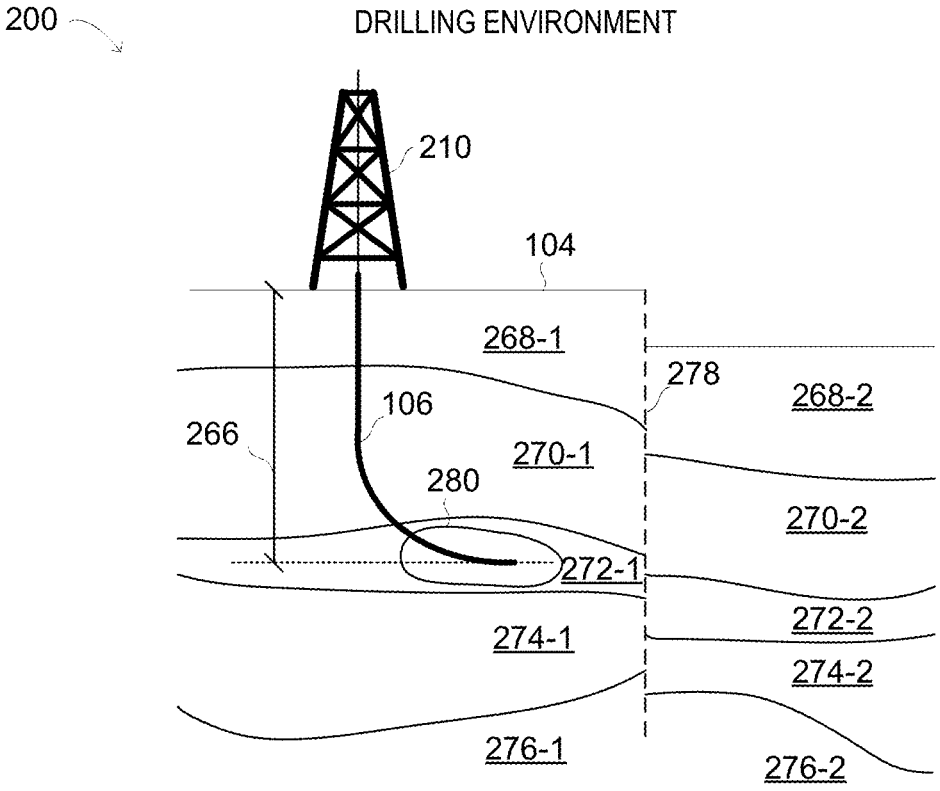
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG.

2, drilling rig 210 may represent various equipment discussed above with respect to drilling system 100 in FIG. 1 that is located at the surface 104.

In drilling environment 200, it may be assumed that a drill plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drill plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drill plan using subsurface coordinates, or references to certain markers, which indicate where borehole 106 is to be terminated. In other instances, target area may be specified in the drill plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used to alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 172. As such, directional drilling may involve multiple vertical adjustments that complicate the trajectory of borehole 106.

Figure 3:
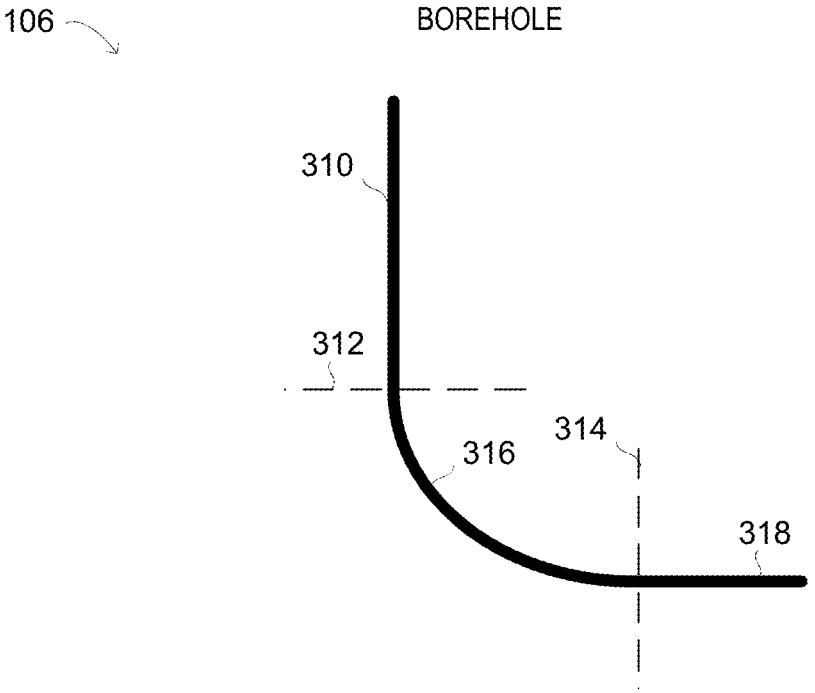
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination in buildup section 316 per measured length drilled is referred to herein as a "build rate" and may be defined in degrees per one hundred feet drilled. For example, the build rate may have a value of 6°/100 ft., indicating that there is a six-degree change in inclination for everyone hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and re-drilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form a borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a toolface is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
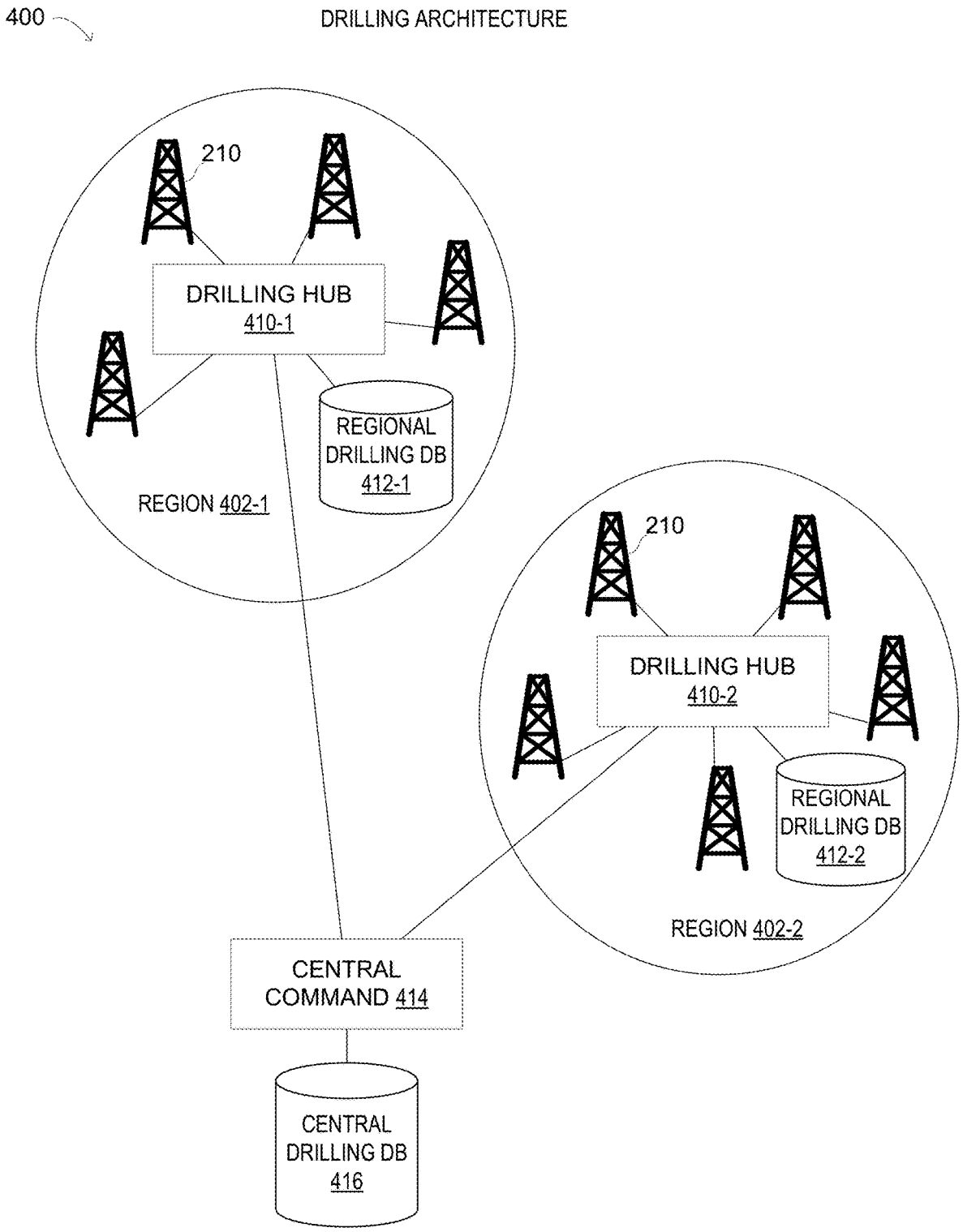
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in different stages of drilling through the depths of formation strata layers at region 402. Thus, for any given well being drilled by drilling rig 210 in a region 402, survey data from the reference wells or offset wells may be used to create the drill plan and may be used for improved drilling performance. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drill plan for drilling rig 210 may include processing and analyzing the collected data in regional drilling DB 412 to create a more effective drill plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
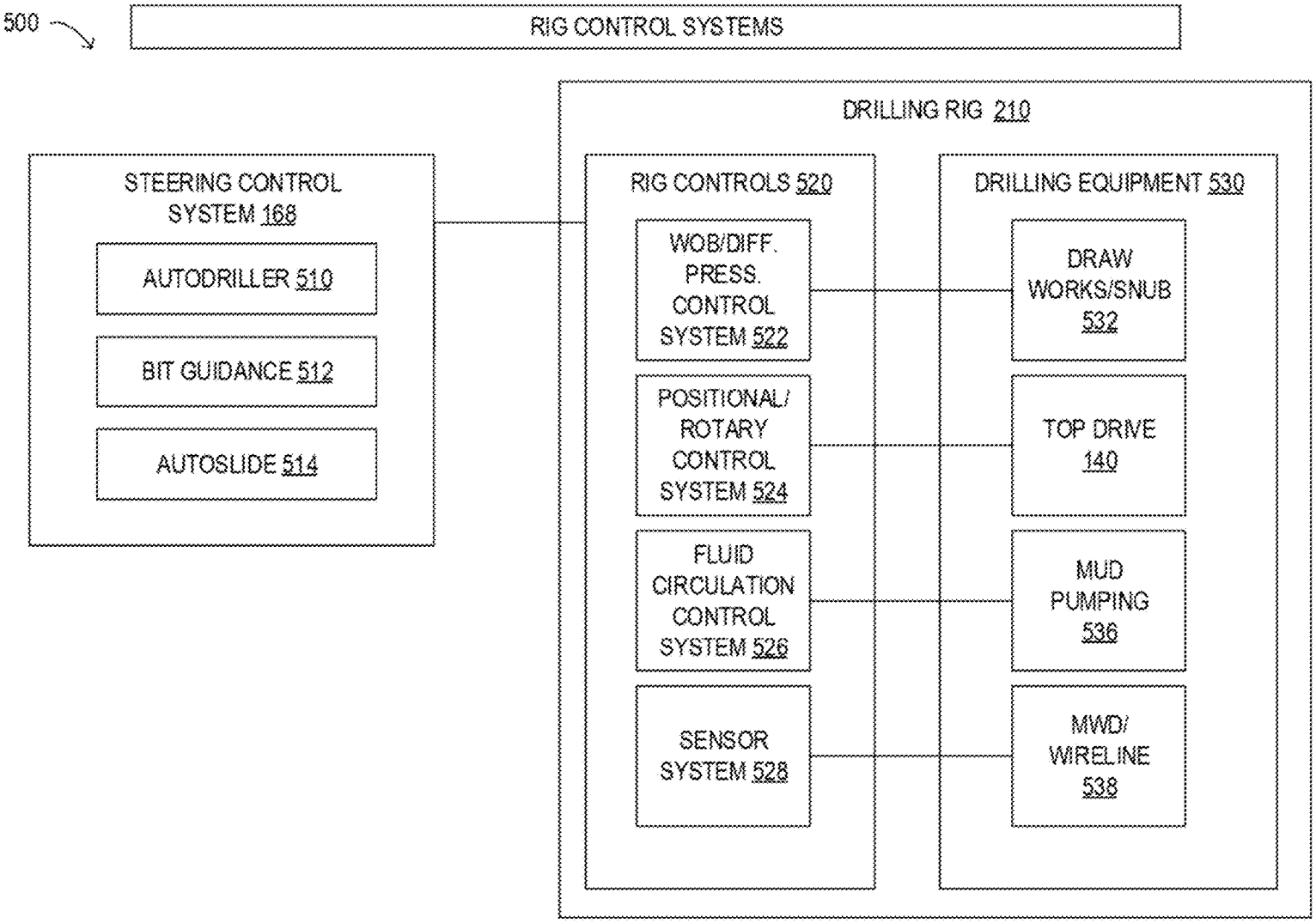
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, mud pumping equipment 536, and MWD/wireline equipment 538.

Figure 10:
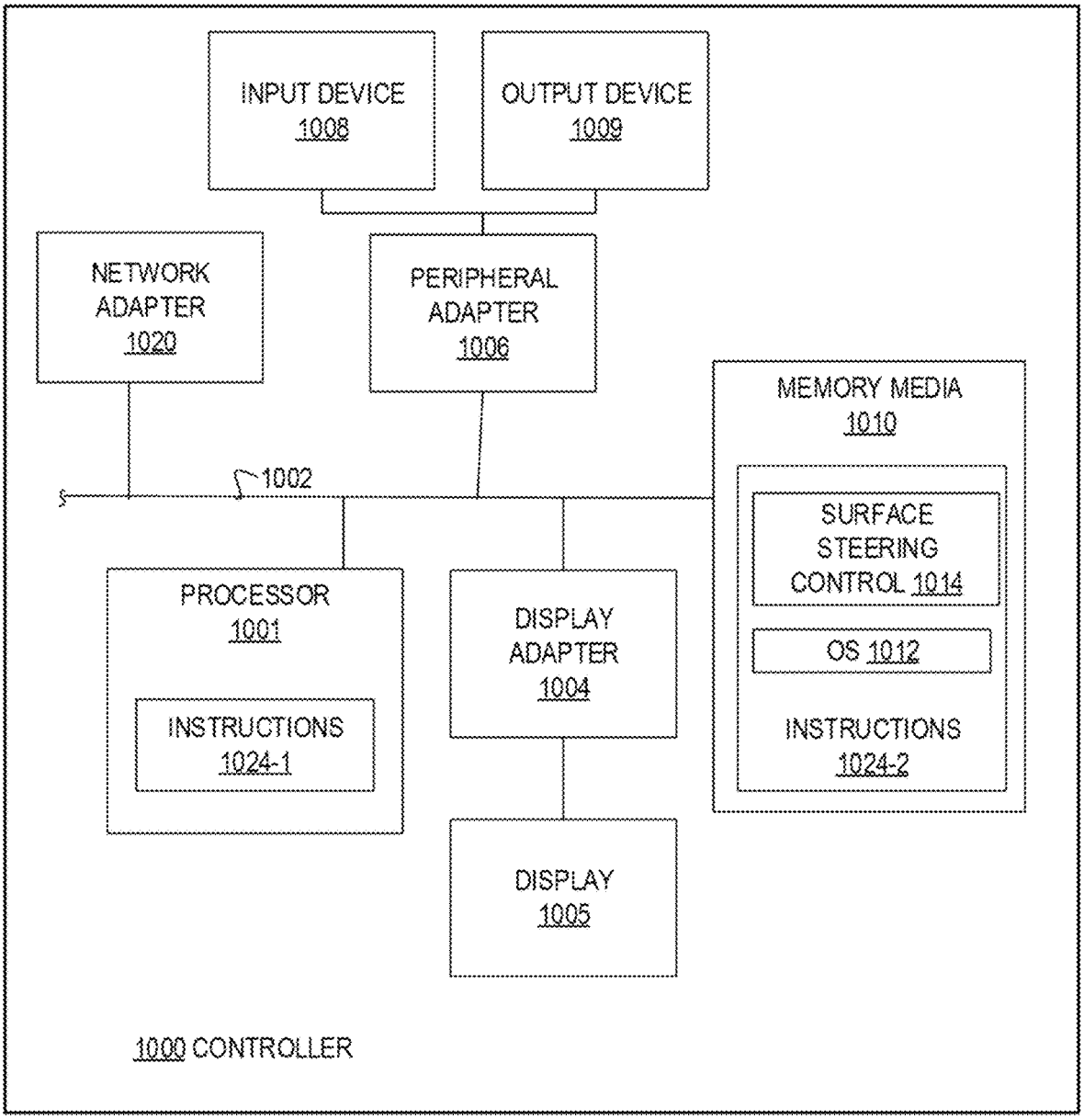
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping equipment 536 to control mud flow and may also receive and decode mud telemetry signals. Sensor system 528 may be interfaced with MWD/wireline equipment 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the drill plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide and may return control to steering control system 168 for rotary drilling at an appropriate time, as indicated in the drill plan. In particular implementations, autoslide 514 may be enabled to provide a user interface during slide drilling to specifically monitor and control the slide. For example, autoslide 514 may rely on bit guidance 512 for orienting a toolface and on autodriller 510 to set WOB or control rotation or vibration of drill string 146.

Figure 6:
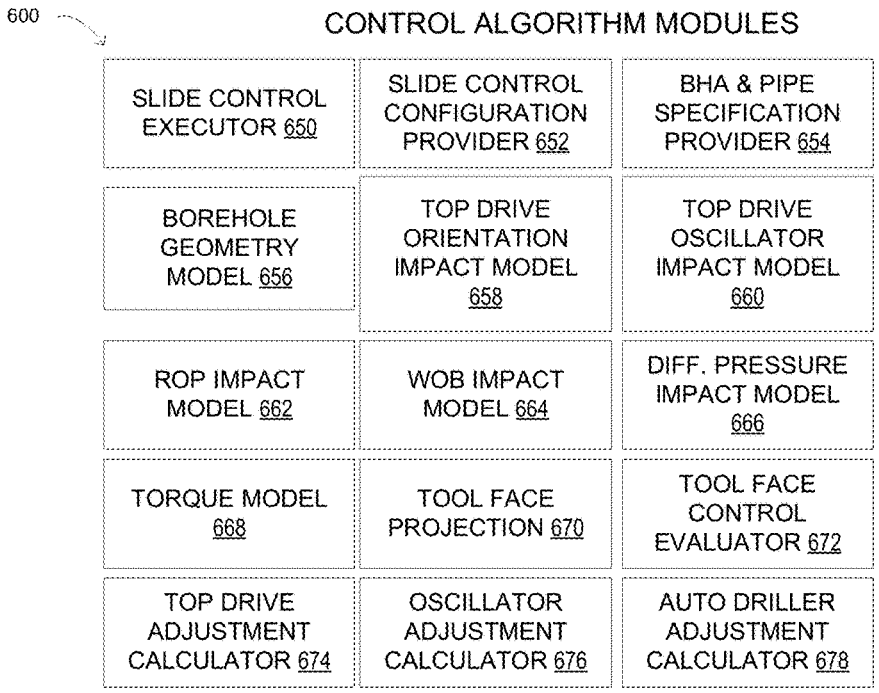
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the toolface control; a top drive oscillator impact model 660 that is responsible for modeling the impact that oscillations of top drive 140 has had on the toolface control; an ROP impact model 662 that is responsible for modeling the effect on the toolface control of a change in ROP or a corresponding ROP set point; a WOB impact model 664 that is responsible for modeling the effect on the toolface control of a change in WOB or a corresponding WOB set point; a differential pressure impact model 666 that is responsible for modeling the effect on the toolface control of a change in differential pressure (DP) or a corresponding DP set point; a torque model 668 that is responsible for modeling the comprehensive representation of torque for surface, downhole, break over, and reactive torque, modeling impact of those torque values on toolface control, and determining torque operational thresholds; a toolface control evaluator 672 that is responsible for evaluating all factors impacting toolface control and whether adjustments need to be projected, determining whether realignment off-bottom is indicated, and determining off-bottom toolface operational threshold windows; a toolface projection 670 that is responsible for projecting toolface behavior for top drive 140, the top drive oscillator, and auto driller adjustments; a top drive adjustment calculator 674 that is responsible for calculating top drive adjustments resultant to toolface projections; an oscillator adjustment calculator 676 that is responsible for calculating oscillator adjustments resultant to toolface projections; and an autodriller adjustment calculator 678 that is responsible for calculating adjustments to autodriller 510 resultant to toolface projections.

Figure 7:
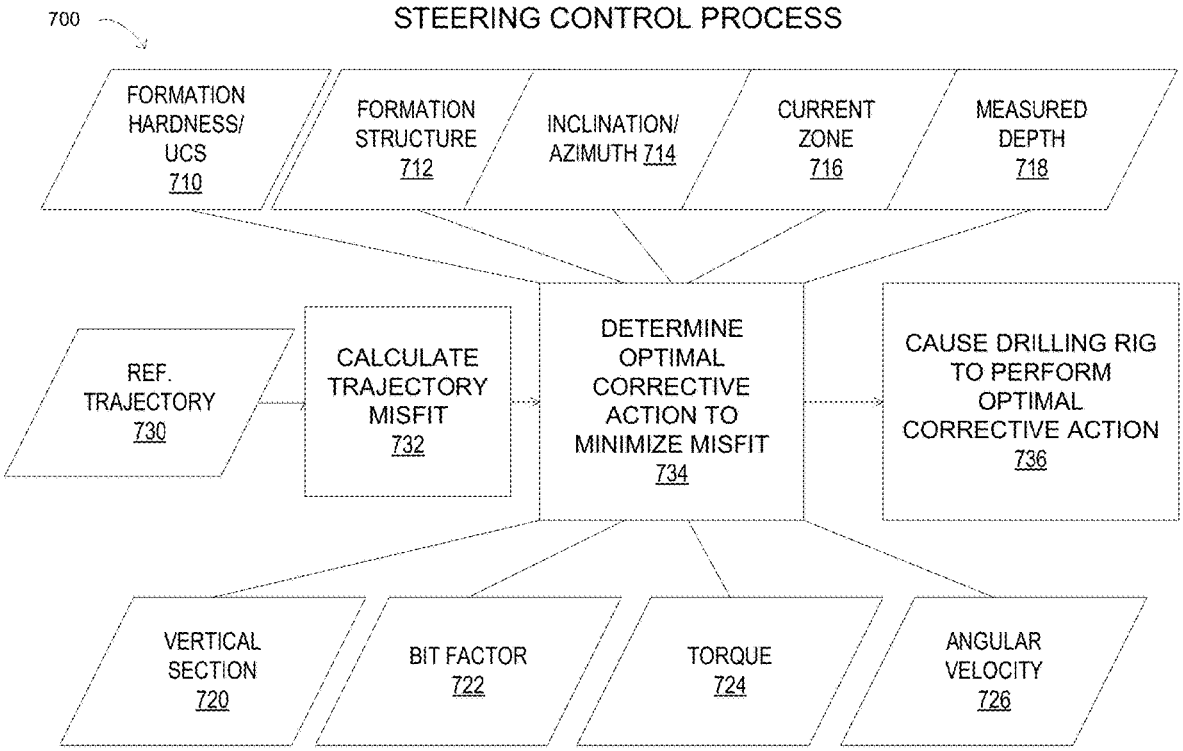
FIG. 7 is a depiction of a steering control process used by the rig control systems.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired toolface 730, vertical section 720, bit factor 722, mud motor torque 724, reference trajectory 730, and angular velocity 726. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention, such as using rig control systems 700 (see FIG. 7). In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
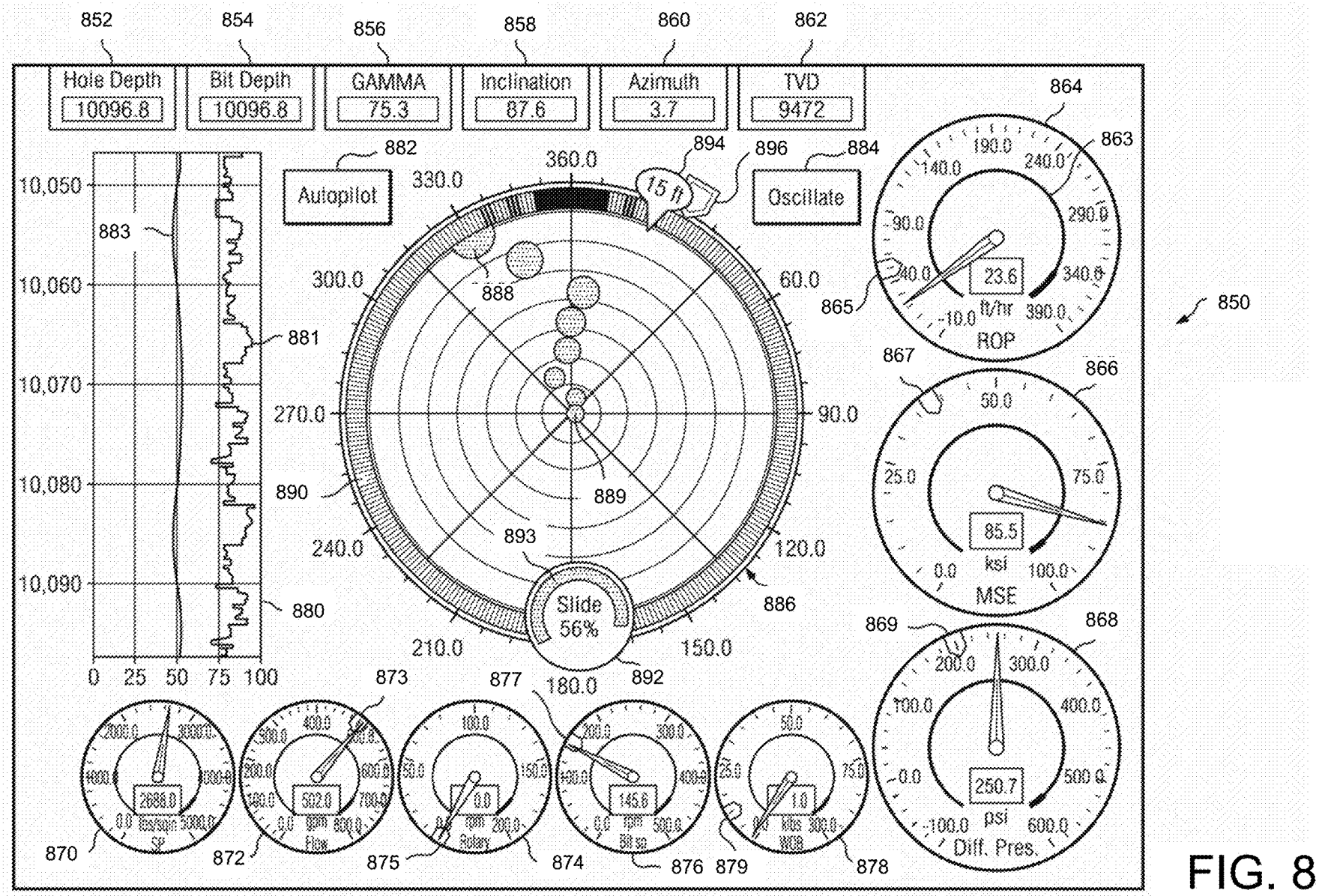
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168. In some embodiments, at least certain portions of user interface 850 may be displayed to and operated by a user of steering control system 168 on a mobile device, such as a tablet or a smartphone (see also FIG. 10). For example, steering control system 168 may support mobile applications that enable user interface 850, or other user interfaces, to be used on the mobile device, for example, within a vicinity of drilling rig 210.

As shown in FIG. 8, a user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 ksi (or 255 MPa). Differential pressure indicator 868 may include a marker 869 indicating that the target value is 200 psi (or 1,380 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gallons per minute (gpm) (or 31.5 L/s). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 kilo-pounds (klbs) (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical toolface orientation information (e.g., which way the bend is pointed). For purposes of illustration, circular chart 886 represents three hundred and sixty degrees. A series of circles within circular chart 886 may represent a timeline of toolface orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular toolface orientation with little deviation. As shown in user interface 850, the color blue may extend from approximately 22-337 degrees, the color green may extend from approximately 15-22 degrees and 337-345 degrees, the color yellow may extend a few degrees around the 13- and 345-degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 864 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 864 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
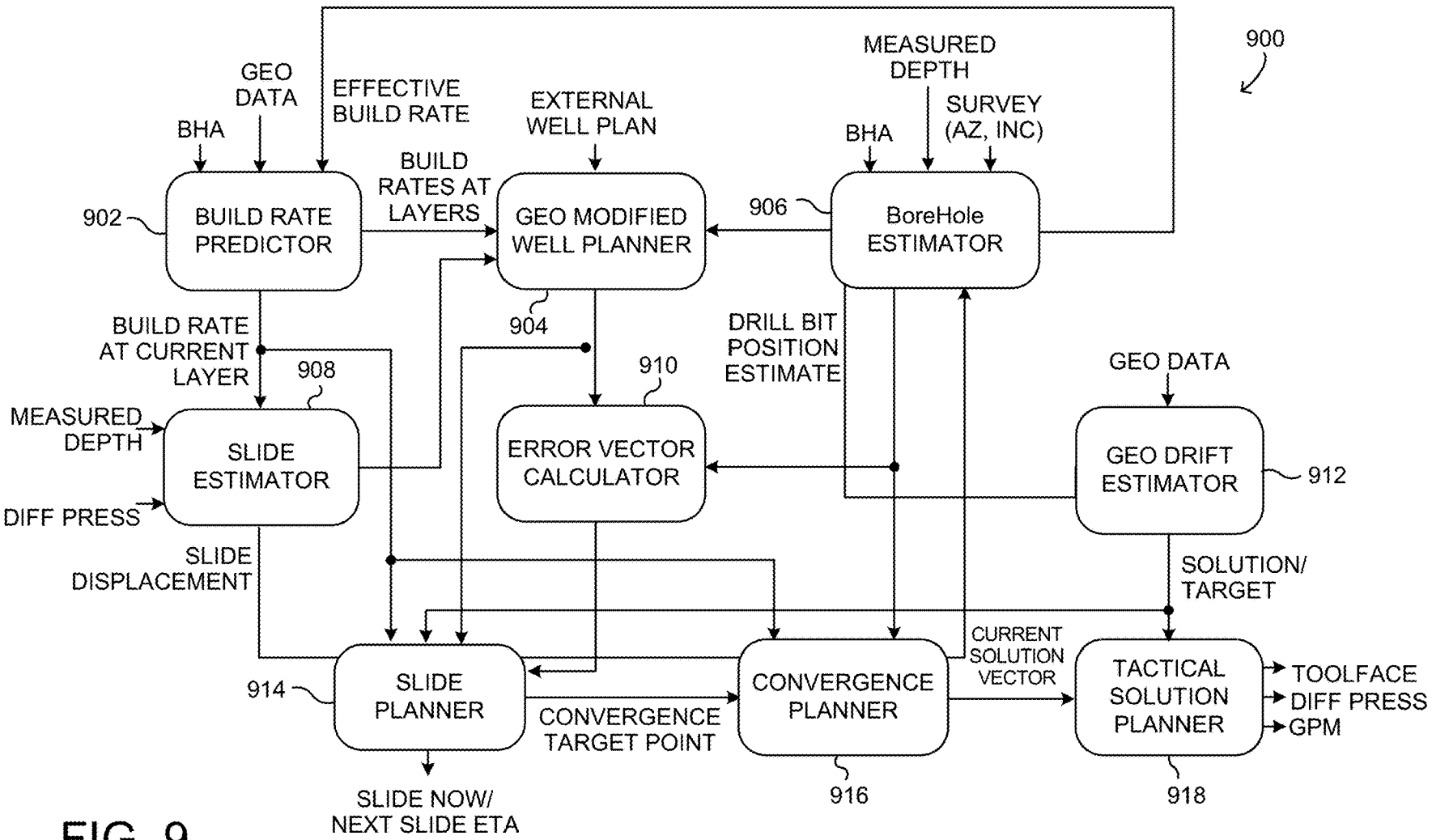
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90-degree angle may provide a good toolface and a clean drill entry, while approaching the rock layer at a 45-degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a drill plan, internal input from build rate predictor 902 and geo drift estimator 912 and provides output to slide planner 914 and error vector calculator 910. Geo modified well planner 904 uses the input to determine whether there is a more optimal trajectory than that provided by the drill plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original drill plan. In some embodiments, geo modified well planner 904 may be an optional module that is not used unless the drill plan is to be modified. For example, if the drill plan is marked in steering control system 168 as non-modifiable, geo modified well planner 904 may be bypassed altogether or geo modified well planner 904 may be configured to pass the drill plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight-line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample toolface orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each toolface update may be algorithmically merged with the average differential pressure of the period between the previous and current toolface readings, as well as the MD change during this period to predict the direction, angular deviation, and MD progress during the period. As an example, the periodic rate may be between 10 and 60 seconds per cycle depending on the toolface update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the drill plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in BHA wear, expected build rates of current and expected formations, and the drill plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50-foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the toolface before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes toolface orientation and other parameters. When rotating is started again, drill string 146 starts to wind back up. Slide planner 914 may account for the reactional torque so that toolface references are maintained, rather than stopping rotation and then trying to adjust to an optimal toolface orientation. While not all downhole tools may provide toolface orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay or planned for implementation at a future time that is specified in advance.

In FIG. 9, tactical solution planner 918 receives internal inputs from geological drift estimator 912 and convergence planner 916 and provides external outputs representing information such as toolface orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole toolface. Accordingly, GCL 900 may receive information corresponding to the rotational position of the drill pipe on the surface. GCL 900 may use this surface positional information to calculate current and desired toolface orientations. These calculations may then be used to define control parameters for adjusting the top drive 140 to accomplish adjustments to the downhole toolface in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a/differential pressure model, a positional/rotary model, an MSE model, an active drill plan, and control limits. The drilling model class may produce a control output solution and may be executed via a main processing loop that rotates through the various modules of GCL 900. The drill bit model may represent the current position and state of drill bit 148. The drill bit model may include a three-dimensional (3D) position, a drill bit trajectory, BHA information, bit speed, and toolface (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active drill plan represents the target borehole path and may include an external drill plan and a modified drill plan. The control limits represent defined parameters that may be set as maximums and/or minimums. For example, control limits may be set for the rotary RPM in the top drive model to limit the maximum rotations per minute (RPM) to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing steering methods and systems for improved drilling performance according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

As noted previously, steering control system 168 may support the display and operation of various user interfaces, such as in a client/server architecture. For example, steering control 1014 may be enabled to support a web server for providing the user interface to a web browser client, such as on a mobile device or on a personal computer device. In another example, steering control 1014 may be enabled to support an app server for providing the user interface to a client app, such as on a mobile device or on a personal computer device. It is noted that in the web server or the app server architecture, surface steering control 1014 may handle various communications to rig controls 520 while simultaneously supporting the web browser client or the client app with the user interface.

Systems and Methods for Controlling WOB

In some embodiments, systems and methods for controlling weight on bit (WOB) may be used to monitor and control drilling operations. In various embodiments, systems and methods for controlling surface weight on bit (SWOB) may include characterizing an average force profile for multiple wells and determining whether the average force profile exhibits force disturbances at consistent well elevator positions. The techniques can include receiving a data stream of hook load and elevator position data. The technique can include applying a force correction to the hook load during tool joint passing events, thus eliminating ROP transients. In certain embodiments, systems and methods for regulating WOB may receive force profile data and sensor measurements, such as but not limited to WOB, torque, and differential pressure for current position of the tool joint and can provide an adjustment to the ROP. In some embodiments, systems and methods for regulating WOB can allow an operator to adjust a set point for the autodriller ROP limit.

Figure 11:
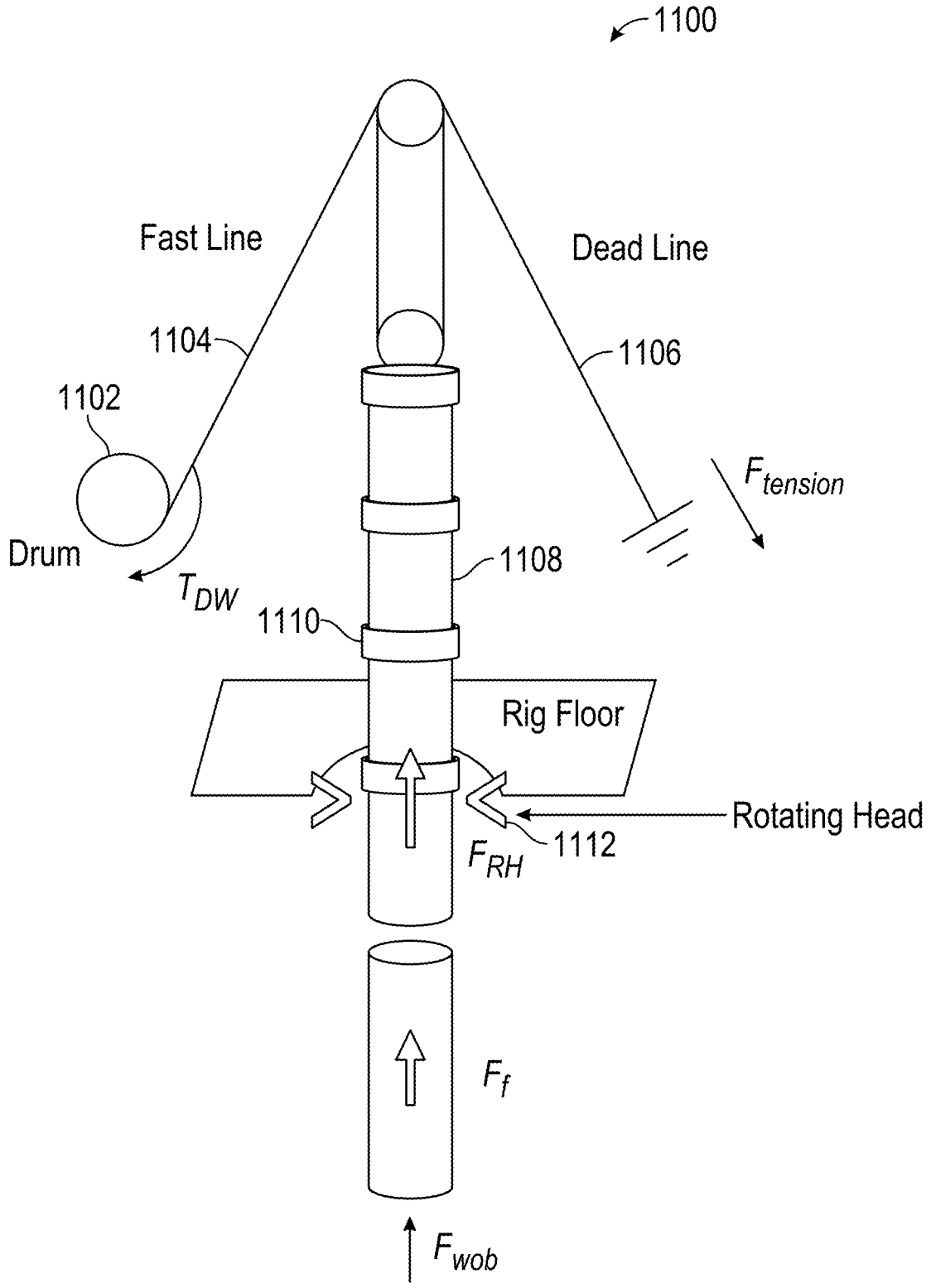
FIG. 11 is a depiction of a draw works according to an embodiment of the invention.

Referring now to FIG. 11, a draw works 1100 is illustrated according to an embodiment of the invention. The draw works 1100 may include a drum 1102, a fast line 1104, and a deadline 1106. In the illustrated embodiment, forces acting on the drill string 1108 are shown. In automated drilling systems (e.g., AutoDriller), block velocity can be manipulated within upper and lower bounds based at least in part on one or more drilling parameters (e.g., WOB, torque, and $\Delta P$). Block velocity can be manipulated by the steering control system 168, as shown in FIG. 1, which may be coupled to a rig control system or systems, such as autodriller 510, as shown in FIG. 5, with bounds that may be manipulated by control system 168 or another control system. Tool joints 1110 or upsets in the pipe diameter may lead to a steep increase in estimated WOB when the tool joints 1110 pass through a rotating head 1112. This is because the tool joints 1110 can have greater outside diameters than the rest of the pipe which increases the friction between the pipe and rotating head 1112. If regulating SWOB, the AutoDriller 510 may in conventional approaches react to the increase in SWOB, as a result of tool joint 1110 interference with the rotating head 1112, by reducing block velocity which thereby increases drilling time. Over the length of a well, the tool joint 1110 passage through the rotating head 1112 can result in an 11% increase in drilling time.

An additional challenge in accounting for the transient increases in WOB due to tool joints 1110 is that each tool joint 1110 is not located at the same position on the drill pipe, and is therefore difficult to detect and mitigate the tool joint passage events at preselected intervals, such as every 30 feet or every half hour or the like.

In some embodiments, systems and methods for regulating WOB can monitor and determine tool joint 1110 positions relative to the rotating head 1112 to predict increases in observed WOB. This can allow the control system 168 to manipulate a tension signal to correct for friction at the rotating head 1112 and help smooth out the ROP for the drill string 1108. In various embodiments disclosed herein, systems and methods for regulating WOB can reduce the magnitude of block velocity transients due to the rotating head 1112, while providing for a robust response to downhole disturbances effecting WOB.

In some embodiments, a surface weight on bit (SWOB) can be computed from a load cell at a deadline 1106 anchor as shown in FIG. 11. Passing the tool joints 1110 through the rotating head 1112 may require a large axial force. This axial force can be provided by the weight of the drill string 1108 and can reduce the hook load required to support the weight of the pipe assuming a constant force at the bit (e.g., WOB). Hook load can be calculated using the following equations:

$$F_{hook\ load(t)}=F_{weight}-F_{wob(t)}-F_{f(t)}-F_{RH(t)}$$

wherein:

$F_{hook\ load}=F_{tension}*N_{lines}$=axial force at the top of the pipe $F_{tension}$=deadline tension $N_{lines}$=number of lines in the drawworks SWOB=surface WOB, which is an estimate of downhole WOB $F_0$=zeroed value of tension which represents F_weight−F_f(t)

$F_{weight}$ the measured weight of the drill string $F_{f(t)}$=the amount of the friction force on the drill string $F_{wob}$=axial force at the bit or WOB $F_f$=axial force of friction between wellbore and pipe $F_{RH}$=axial force of friction between pipe and rotating head Assuming steady conditions downhole, i.e., constant block velocity and a smooth formation can result in constant $F_f$ and $F_{wob}$, FR may be estimated from the hookload $F_{hook\ load}$ using the equation above.

Figure 12:
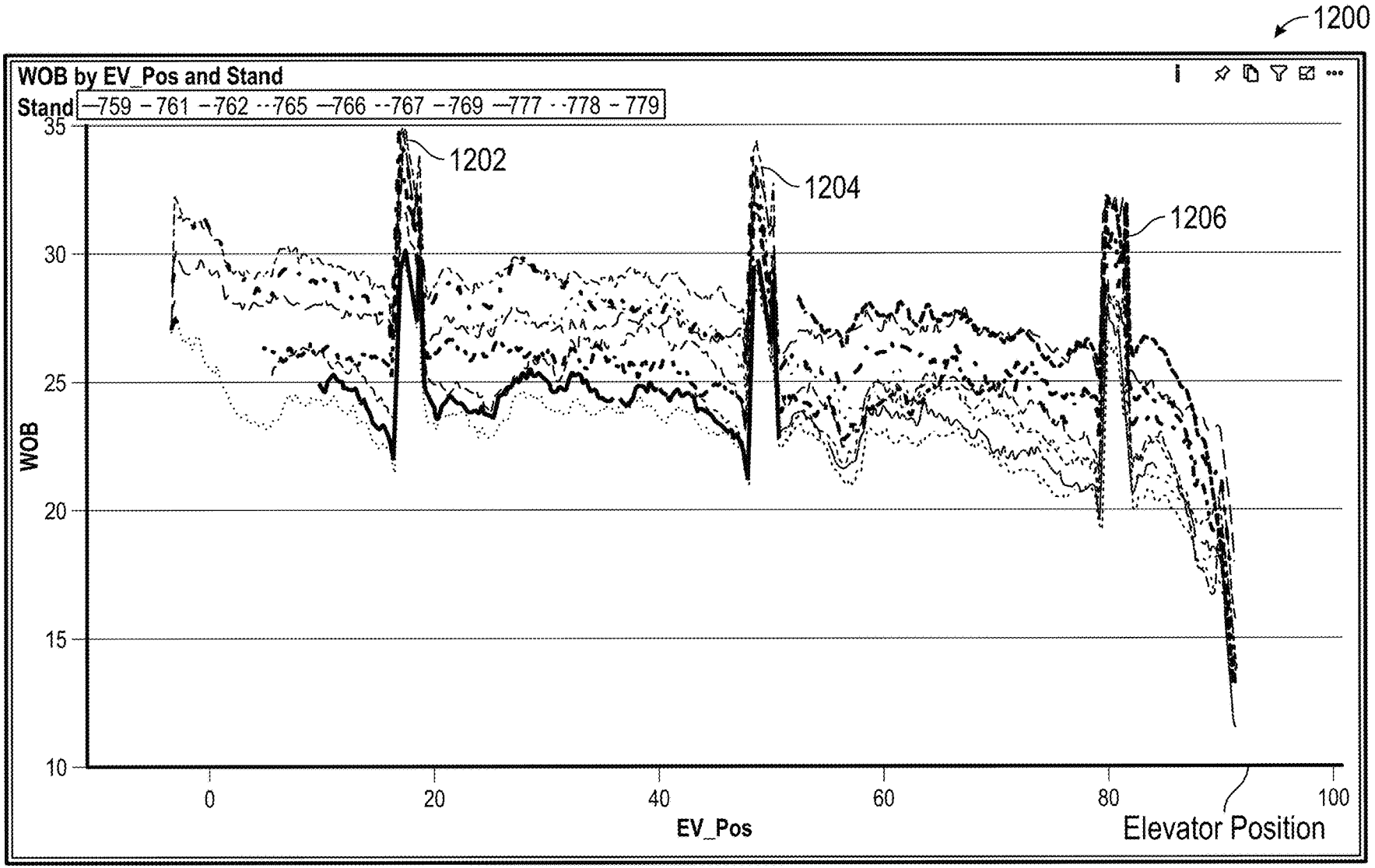
FIG. 12 shows an exemplary graph of surface weight-on-bit (SWOB) as a function of block position.

FIG. 12 shows a graph 1200 of SWOB as a function of block position for several stands overlaid (e.g., stands 759, 761, 762, 765, 766, 767, 769, 777, 778, and 779). The data in graph 1200 illustrates SWOB as function of block position when SWOB is not regulated, i.e., using a constant block velocity. Graph 1200 shows an effect of the rotating head on SWOB. In graph 1200, SWOB peaks occur at points 1202, 1204, and 1206. These peaks 1202, 1204, and 1206 are consistent with the passage of the tool joints through the rotating head. This data can enable observation of variation in position of the traveling block when the tool joints pass through the rotating head.

In some embodiments, systems and methods for regulating WOB may calibrate the expected position of the traveling block (or elevator which is offset by a constant value from the traveling block) when the tool joints reach the rotating head. At these positions, an average force profile can be added to the SWOB or hookload signal. In some situations, such as indicated by graph 1200, the tool joint positions may be consistent enough to use an open-loop solution, based on average force profile and calibration or block position relative to the rotating head, to reduce transients in block velocity resulting from tool joint interference with the rotating head. In various embodiments, systems and methods for regulating WOB may use a consistent force profile as shown in graph 1200. In some embodiments, systems and methods for regulating WOB can use force profile data from multiple rigs. In various embodiments, systems and methods for regulating WOB can use drilling data to determine the variation in block positions when the tool joints reach the rotating head. Data variations between stands on a single rig can be characterized, as well as variations between stands from multiple rigs can be determined. While tool joint positions can be assumed to be consistent from pipe segment to pipe segment, it seems more likely that an assumption that the tool joints are not consistently positioned is the better approach.

In some embodiments, calibration can be done for the data from each well independently in order to address the variations in positions between multiple rigs. In certain embodiments, simulation tools can be utilized to perform simulations to determine an acceptable amount of variation in positions of block position for tool joint passage events for different drilling events using a single rig. Such variations in block position can be used to set thresholds or ranges for the control system to determine whether and/or how much to compensate for a measured increase in SWOB. In some embodiments, systems and methods for regulating WOB can use the simulation results to calibrate tool joint positions once for each well and can reduce ROP transients below a predetermined threshold rate (e.g., 20 feet per hour) while allowing response to downhole WOB. The threshold value for maximum allowable ROP transients can be adjusted by the driller.

In some embodiments, systems and methods for controlling SWOB can include performing characterization of force over distances as a tooljoint passes through the rotating head. In various embodiments, systems and methods for controlling SWOB can use an average weight profile by including the weight profile into the control process in order to determine the hook load in cases where some of the weight is not being held up by the rotating head. In certain embodiments, systems and methods for controlling SWOB may include various logic systems which can be added to the ROP command. In order to prevent oscillatory behavior of the SWOB control process, the ROP logic can bring the ROP command towards a mean value of ROP. In certain embodiments, systems and methods for regulating WOB may perform WOB control while providing resilience to changes in rock hardness or changes in WOB set point.

Figure 13:
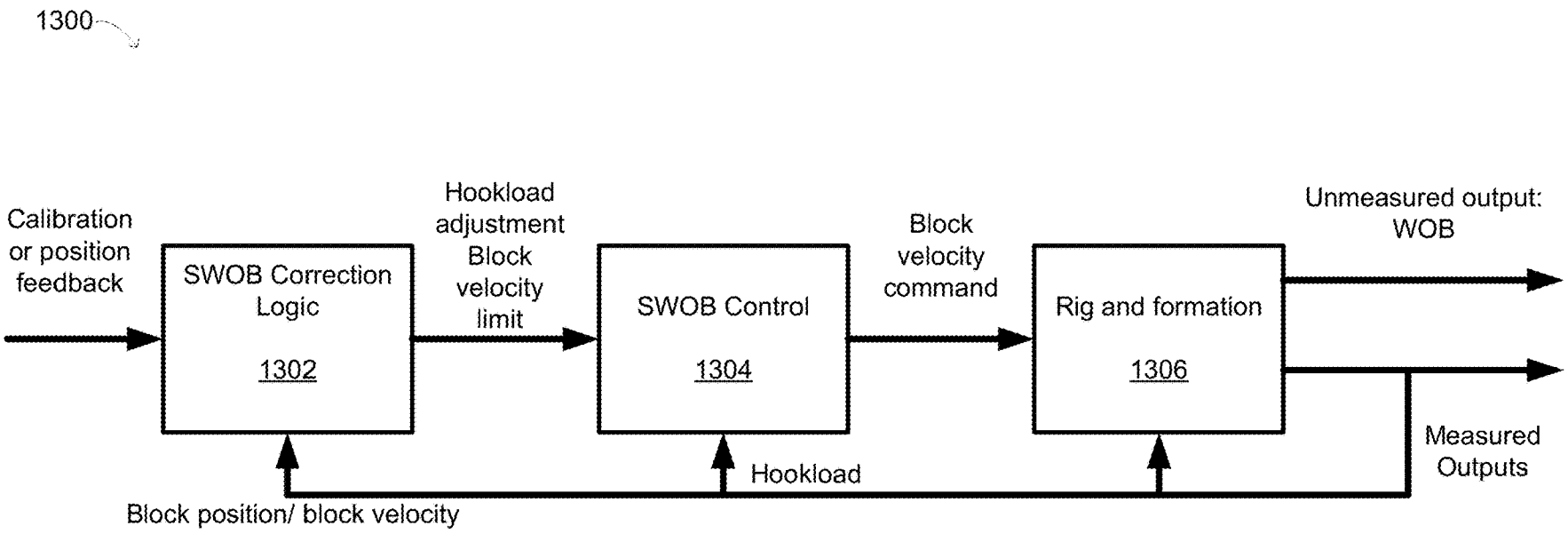
FIG. 13 shows an exemplary block diagram illustrating a logic module for controlling WOB according to the present disclosure.

Referring now to FIG. 13, a block diagram illustrating exemplary elements of an Autodriller Input/Output (IO) system 1300 for regulating WOB is shown according to the present disclosure. According to FIG. 13, the system 1300 can include (among other things) a SWOB Correction Logic Module 1302, SWOB Control Module 1304, and Rig and Formation Module 1306.

In accordance with various embodiments, the SWOB Correction Logic Module 1302 can receive calibration or position feedback data. The SWOB Correction Logic Module 1302 can also receive block position data from the rig. The SWOB Correction Logic Module 1302 can also receive block velocity data from the rig. The SWOB Correction Logic Module 1302 can analyze the block position and block velocity data to determine an estimated position of the tool joints. The SWOB Correction Logic Module 1302 can use the calibration and/or feedback data to generate a hookload adjustment value that can be timed to correspond to the location of the tool joints. The SWOB Correction Logic Module 1302 can generate a block velocity limit. The block velocity limit can be timed to correspond to the location and/or expected location of the tool joints. The SWOB Correction Logic Module 1302 can send the hookload adjustment value to the SWOB Control Module 1304.

The SWOB Control Module 1304 can be part of the AutoDriller 510, as shown in FIG. 5, or part of the steering control system 168, as shown in FIG. 1. The SWOB Control Module 1304 can receive the hookload value as one of the measured outputs of the rig. The SWOB Control Module 1304 can receive the hookload adjustment value and the block velocity limit from the SWOB Correction Logic 1302. The SWOB Control Module 1304 can generate a block velocity command based at least in part on the received inputs. The SWOB Control Module can send the block velocity command to the Rig and Formation Module 1306.

The Rig and Formation Module 1306 can receive the block velocity command from the SWOB Control Module 1304. The Rig and Formation Module 1306 can apply the velocity command to regulate WOB as required. The Rig and Formation Module 1306 can receive one or more drilling parameters from the drill rig. In various embodiments, the drilling parameter values can include differential pressure, WOB, ROP, RPM, toolface, hookload value, block position, block velocity, and depth of drill string. The Rig and Formation Module 1306 can send one or more of the drilling parameter values to the SWOB Correction Logic Module 1302, the SWOB Control Module 1304 and various other system components.

Figure 14A:
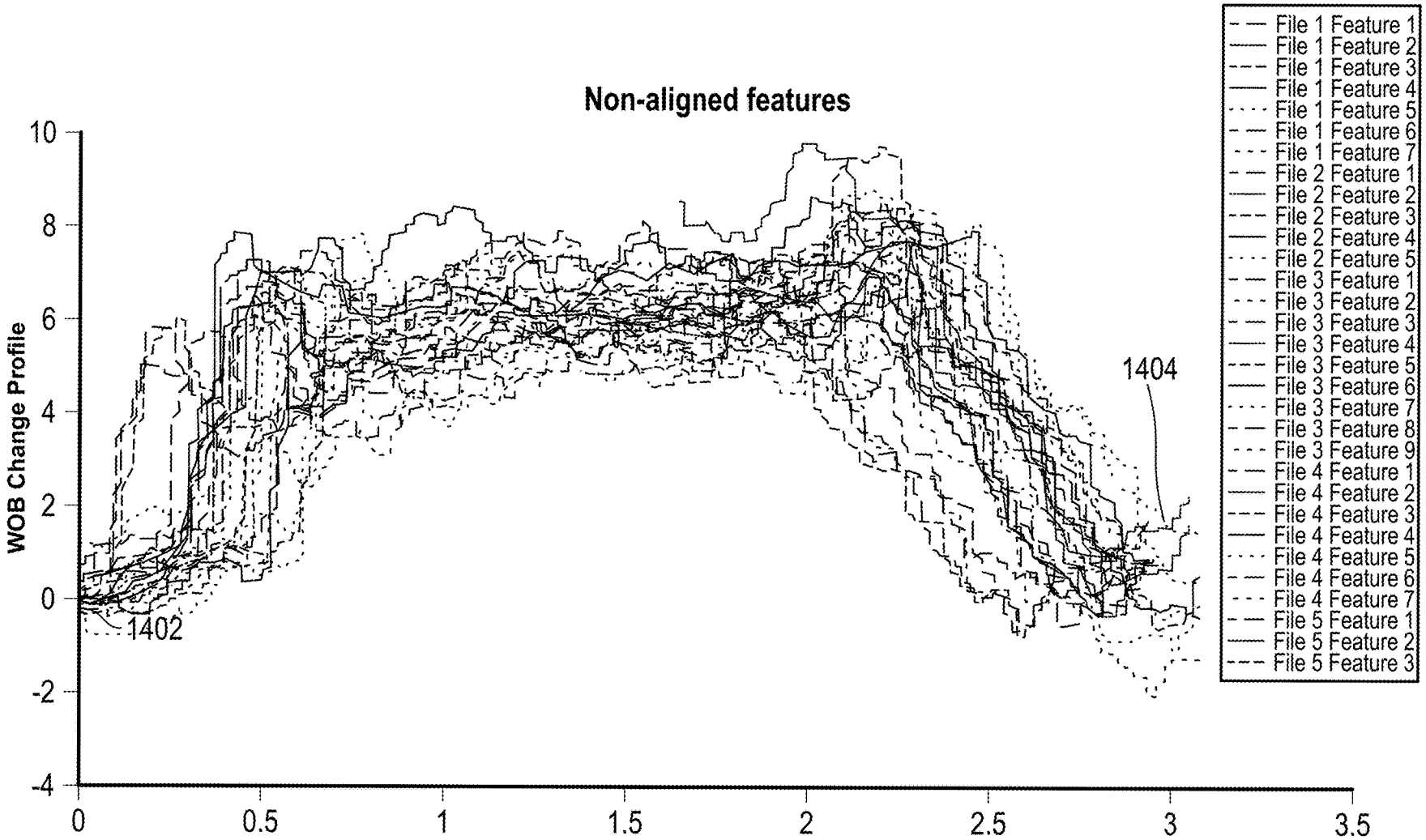
FIGS. 14A-14C illustrate an exemplary method for identifying an average force profile, according to various embodiments.
Figure 14B:
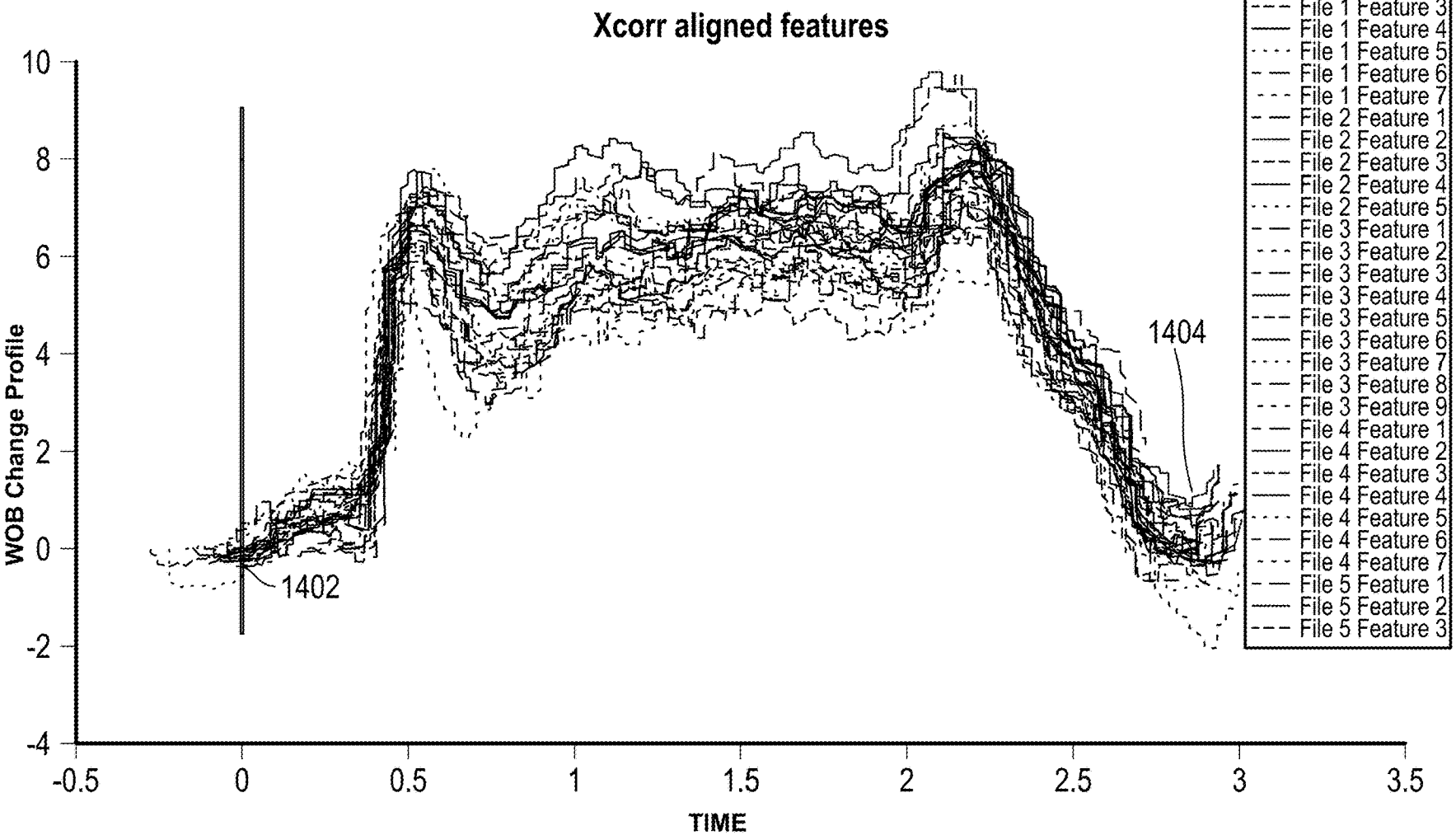
Figure 14C:
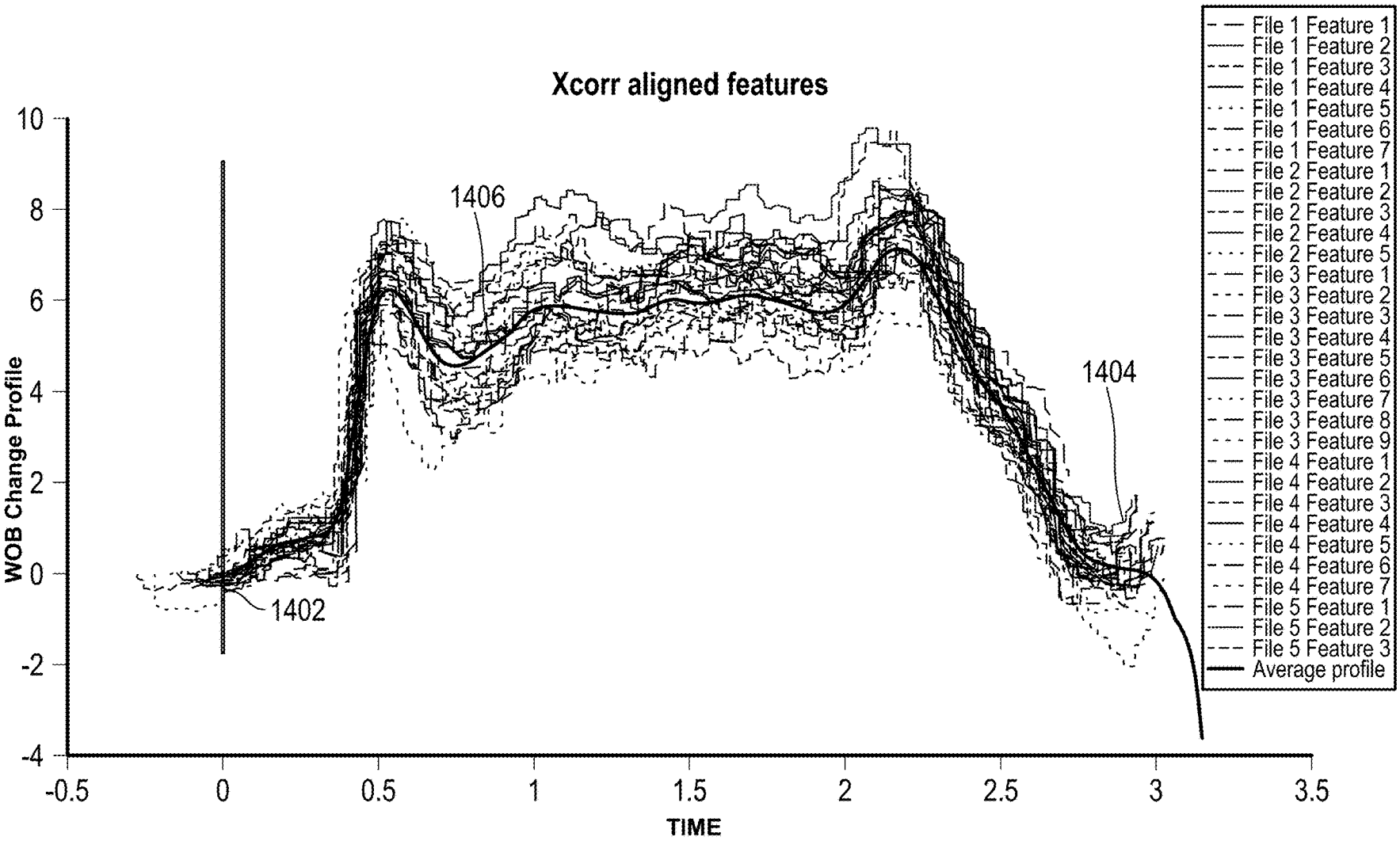

FIGS. 14A-14C illustrate an exemplary method for identifying an average force profile, according to various embodiments. FIGS. 14A-14C illustrates a force profile that is depth indexed. The force profile arises as a result of the tool joint geometry passing by the rotating head geometry. Thus, the profile is fundamentally dependent only on depth (related to lengths of both geometries). In various embodiments, the force profile could also be time-indexed. FIG. 14A illustrates data from a plurality of exemplary wells. The data has been analyzed to identify and record start index and an end index of exemplary events. For each isolated feature, starting WOB can be subtracted to get a WOB change profile over a time index for an event. In FIG. 14B, the WOB change profiles are aligned using cross-correlation. The data has been analyzed to identify and record start index and an end index of exemplary events. FIG. 14C illustrates a smoothed average force profile 1406 as shown with line 1400. The data has been analyzed to identify and record start index and an end index of exemplary events.

Once the average force profile is identified, it is determined whether the events always happen at the same position with respect to an elevator position (e.g., block height) throughout a well. The location can be made tunable to the driller and/or by a control system 168 as shown in FIG. 1 for the drilling rig. For example, the block height may be identified based on the one or more extreme points (e.g., maxima, minima) on the average force profile 1406.

Embodiments further provide a control system that includes a physical tooljoint model that computes the frictional force at a tooljoint nearest the rotating head if the normal force had a constricting force added to it. The tooljoint model can subtract a computed frictional force value from the measured frictional forces to find the friction force addition due to the rotating head. The control system can take a data stream of hook load/elevator position as an input and applies a force correction to the hook load during tooljoint passing events, so that the SWOB does not artificially reflect weight being held by the interface. The control system can be configured to hold ROP command steady while passing for smoothness and resilience against miscalibration. The control system can be configured to compute the difference in the friction force (e.g., the friction force according to the Stribeck friction model) at the rotating head 1112, as shown in FIG. 11, with and without an additional constriction force. The control system can then linearly ramp up to the computed force during tooljoint passing events.

According to various embodiments, the WOB profile can be adjusted using the SWOB Correction Logic Module 1302 as illustrated in FIG. 13. The SWOB Correction Logic Module 1302 can continuously calculate the mean of block velocity. In the presence of a tool joint passing event when the WOB is being regulated or when there is an unchanged ROP limit, the ROP limit is brought smoothly towards the mean of ROP. That is, when a tool joint 1110 as shown in FIG. 11 is about to pass through the rotating head 1112, the system should keep doing what it has been doing, while continuing to respond to increases in adjusted SWOB above the set point and to changes in ROP limit.

Figure 15:
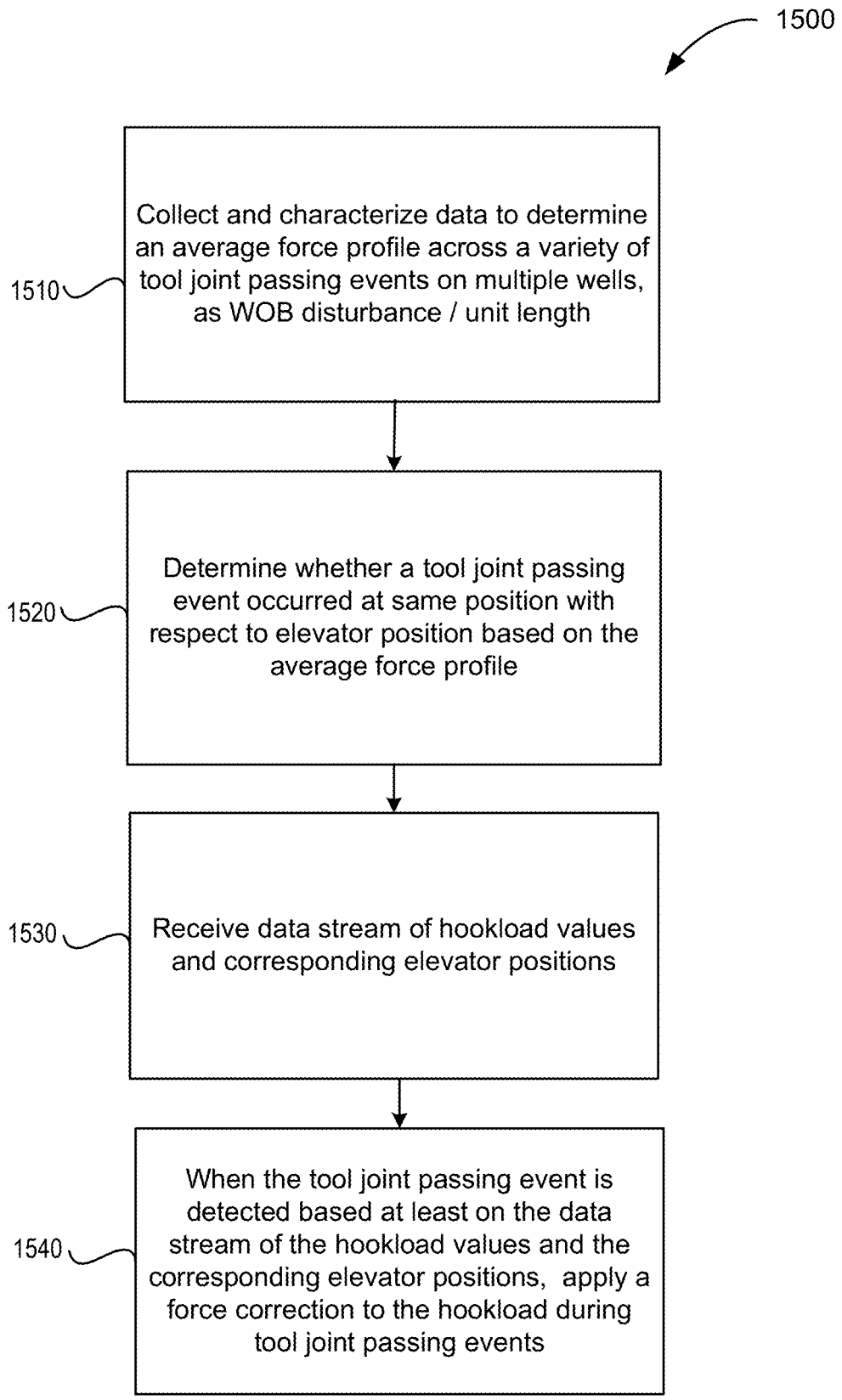
FIG. 15 illustrates an exemplary flowchart for a first exemplary method of controlling weight on bit according to an embodiment of the disclosure.

FIG. 15 illustrates a flowchart of an example process 1500 for regulating WOB according to an embodiment of the disclosure. In some implementations, one or more of the process blocks of FIG. 15 may be performed by the ROP controller 1300. In some implementations, one or more process blocks of FIG. 15 may be performed by another device, or a group of devices separate from or including the ROP controller 1300. Additionally, or alternatively, one or more process blocks of FIG. 15 may be performed by one or more components of ROP controller 1300, such as processor 1302, memory/media 1310, input device 1308, output device 1309, computer instructions 1324, a display 1305, and a bus 1302.

At block 1510, an average force profile across a variety of tool joint passing events on multiple wells can be determined based on collected data from multiple wells. In order to determine an average force profile, a start index/end index of examples across multiple wells can be identified and recorded. Next, a starting WOB can be subtracted off the average force profile to get a WOB change profile, and finally the data can be aligned by computing a cross-correlation and shifting by index shift related to the highest correlation. The steps for determining an average force profile are described in more detail in FIG. 15.

At block 1520, the process 1500 can determine whether a tool joint passing event occurred at same position with respect to elevator position based on the average force profile. The elevator position at which passing events occur can be fine-tuned during the control process.

At block 1530, the process 1500 can receive a data stream of hookload values and corresponding elevator positions. The data stream of hookload values and corresponding elevator positions can be received by sensors on the drilling rig. The data stream of hookload values and the corresponding elevator positions can be stored in a memory of the controller. In some embodiments, a tool can receive the data stream of hookload values and the corresponding elevator positions in order to apply a force correction in subsequent steps.

At block 1540, the process 1500 can apply a force correction to the hookload during the tool joint passing event based on the data stream of the hookload values and the corresponding elevator positions. The process 1500 can calculate the estimate hookload based at least in part on the drilling parameters and to calculate the magnitude of the force correct to be applied.

The force correction can reduce the resulting drop in ROP transient to less than a predetermined rate. For example, in some embodiments the resulting drop in ROP transient can be less than 20 feet/hour. In some embodiments, the average force profile can be updated for multiple wells and the process 1500 can be repeated based on the updated average force profile. In various embodiments, process 1500 can include adding the average force profile to SWOB at the calibrated position. In certain embodiments, process 1500 can include adding a weight profile into the control process in order to determine the hook load when some of the weight is not being held up by the rotating head. In some embodiments, process 1500 can include determining a mean block velocity and adjusting the rate of penetration to the mean block velocity when the tool joint passing event is detected. It will be appreciated that process 1500 is illustrative, and variations and modifications are possible. Steps described as sequential may be executed in parallel, order of steps may be varied, and steps may be modified, combined, added, or omitted.

Figure 16:
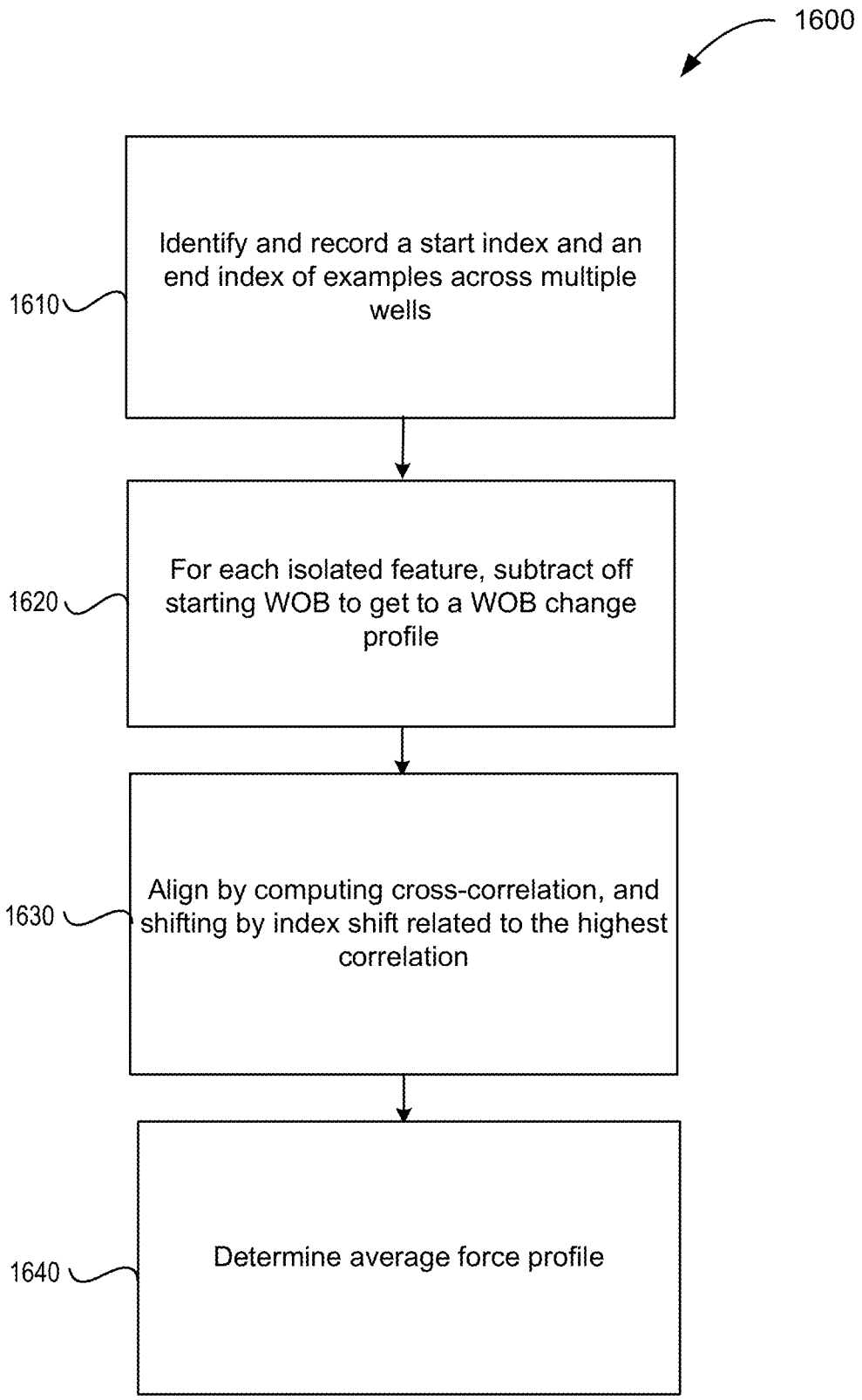
FIG. 16 illustrates an exemplary flowchart for determining an average force profile in accordance with an embodiment of the disclosure.

FIG. 16 illustrates a flowchart of an example process 1600 for determining an average force profile in accordance with an embodiment of the disclosure. In some implementations, one or more of the process blocks of FIG. 16 may be performed by the ROP controller 1300. In some implementations, one or more process blocks of FIG. 16 may be performed by another device, or a group of devices separate from or including the ROP controller 1300. Additionally, or alternatively, one or more process blocks of FIG. 16 may be performed by one or more components of ROP controller 1300, such as processor 1302, memory/media 1310, input device 1308, output device 1309, computer instructions 1324, a display 1305, and a bus 1302.

At block 1610, process 1600 can include identifying drilling data from multiple wells in a database. The drilling data can include one or more drilling parameters (e.g., WOB, torque, and ΔP). The process can include recording a start index and an end index of the data across multiple wells. In some embodiments, datasets from multiple wells can be utilized and features of each manually identified.

At block 1620, for each isolated feature, process 1600 can include subtracting a measured WOB value from a calculated WOB value in order to determine a WOB change profile. The starting WOB can include the weight of the drill string and other BHA components. The WOB change profile can indicate locations of tool joint passage through the rotating head. The isolated feature can include an increased WOB value in during tool joint passage events.

At block 1630, process 1600 can include aligning the data by computing cross-correlation and shifting by an index shift the data related to the highest correlation. This can produce a smoothed force profile.

At block 1640, process 1600 can include determining an average force profile. In various embodiments, the average force profile can be created using the smoothed force profile data. The average force profile can be utilized in process 1500 to produce a force correction. It will be appreciated that process 1600 is illustrative and variations and modifications are possible. Steps described as sequential may be executed in parallel, order of steps may be varied, and steps may be modified, combined, added, or omitted.

Figure 17:
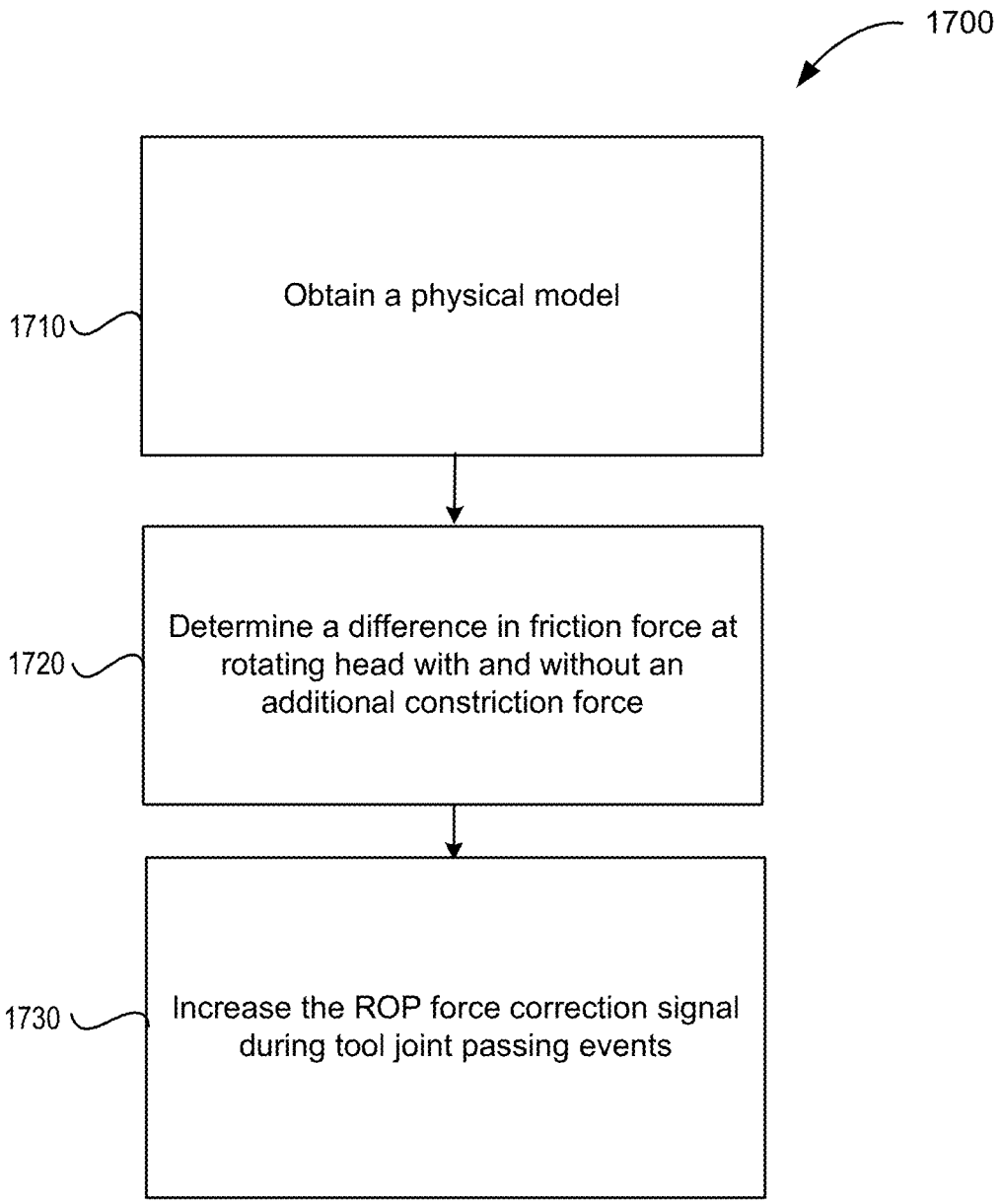
FIG. 17 illustrates an exemplary for determining an ROP force during tool joint passing event in accordance with an embodiment of the disclosure.

FIG. 17 illustrates steps associated with a method 1700 for determining an ROP force during tool joint passing event in accordance with an embodiment of the disclosure. In some implementations, one or more of the process blocks of FIG. 17 may be performed by the ROP controller 1300. In some implementations, one or more process blocks of FIG. 17 may be performed by another device, or a group of devices separate from or including the ROP controller 1300. Additionally, or alternatively, one or more process blocks of FIG. 17 may be performed by one or more components of ROP controller 1300, such as processor 1302, memory/media 1310, input device 1308, output device 1309, computer instructions 1324, a display 1305, and a bus 1302.

At block 1710, process 1700 can include obtaining a physical model for a wellbore. This setup 1710 can be performed by accessing a previously stored physical model, such as a model stored in a database. Step 1710 may also be performed by generating a physical model, such as through simulations as described herein, or by using simulations to update a previously stored physical model.

At block 1720, process 1700 can determine a difference in friction force at rotating head with and without an additional constriction force. This can be determined by calculating what the frictional force would be at a node nearest the rotating head if the normal force had a constricting force added to it, then subtracting off the actual computed frictional force to find the friction force addition due to the rotating head.

At block 1730, process 1700 can increase the ROP force correction signal during tool joint passing events. In various embodiments, the increase in ROP force signal can be linear. It will be appreciated that process 1700 is illustrative and variations and modifications are possible. Steps described as sequential may be executed in parallel, order of steps may be varied, and steps may be modified, combined, added, or omitted.

In some embodiments, systems and methods for regulating WOB can include a ROP force correction. The force correction can add empirically derived force profile to hookload while in the presence of too joint passing event. In various embodiments, systems and methods for regulating WOB can include tunable parameters such as, but not limited to, on/off switch, elevator positions at which passing events occur per stand, and scaling factors.

Figure 18:
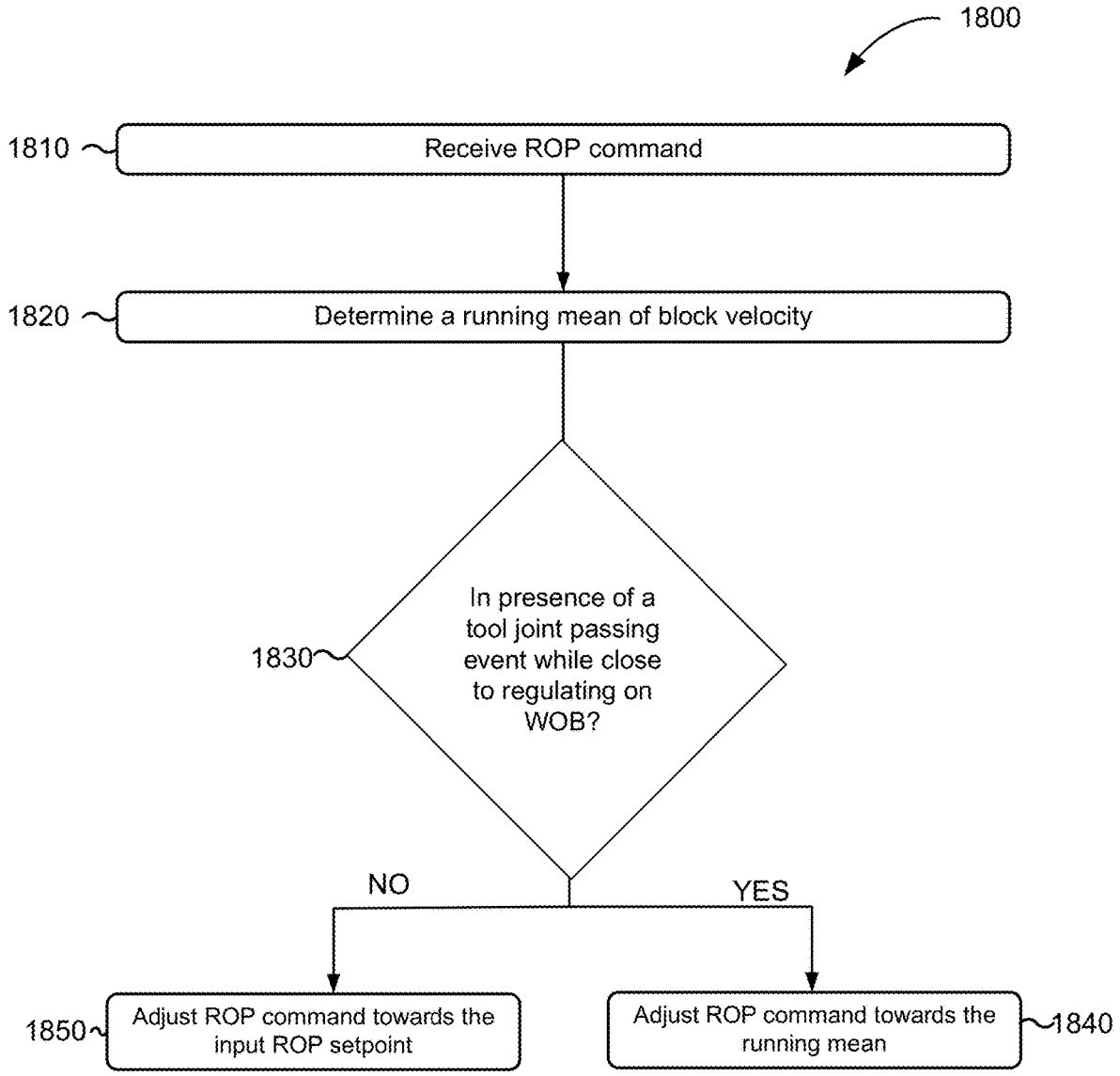
FIG. 18 illustrates an exemplary flowchart for determining whether to set the autodriller ROP limit to an input ROP set point or to an ROP running mean in accordance with an embodiment of the disclosure.

FIG. 18 illustrates exemplary steps associated with a process 1800 for determining whether to set an ROP setting to an input ROP set point or to an ROP running mean in accordance with an embodiment of the disclosure. In some implementations, one or more of the process blocks of FIG. 18 may be performed by the ROP controller 1300. In some implementations, one or more process blocks of FIG. 18 may be performed by another device, or a group of devices separate from or including the ROP controller 1300. Additionally, or alternatively, one or more process blocks of FIG. 18 may be performed by one or more components of ROP controller 1300, such as processor 1302, memory/media 1310, input device 1308, output device 1309, computer instructions 1324, a display 1305, and a bus 1302.

At block 1810, the process 1800 can include receiving an ROP command. The ROP command can be provided by a driller through a user interface of an input device 1308. The ROP command can be stored in the memory 1310 of the ROP controller.

At block 1820, the process 1800 can include determining a running mean of block velocity. The running mean can be determined using the processor 1302 of the ROP controller 1300. The running mean can be stored in the memory 1310 of the ROP controller 1300.

At block 1830, the process 1800 can include determining whether the system is in presence of a tool joint passing event while close to regulating on WOB or with unchanged ROP set point (SP). This can be determined by monitoring the force profile of the WOB and the corresponding elevator positions. Increases in WOB at positions corresponding to elevator positions may be an indication of a tool joint passing event.

If the system is in presence of a tool joint passing event while close to regulating on WOB, then at block 1840 the process 1800 can adjust the ROP command towards the running mean. In various embodiments, the adjustment can be made relatively smoothly.

If the system is not in presence of a tool joint passing event while close to regulating on WOB, in step 1850 process 1800 can adjust the ROP command towards an input ROP setpoint. It will be appreciated that process 1800 is illustrative and variations and modifications are possible. Steps described as sequential may be executed in parallel, order of steps may be varied, and steps may be modified, combined, added, or omitted.

Figure 19A:
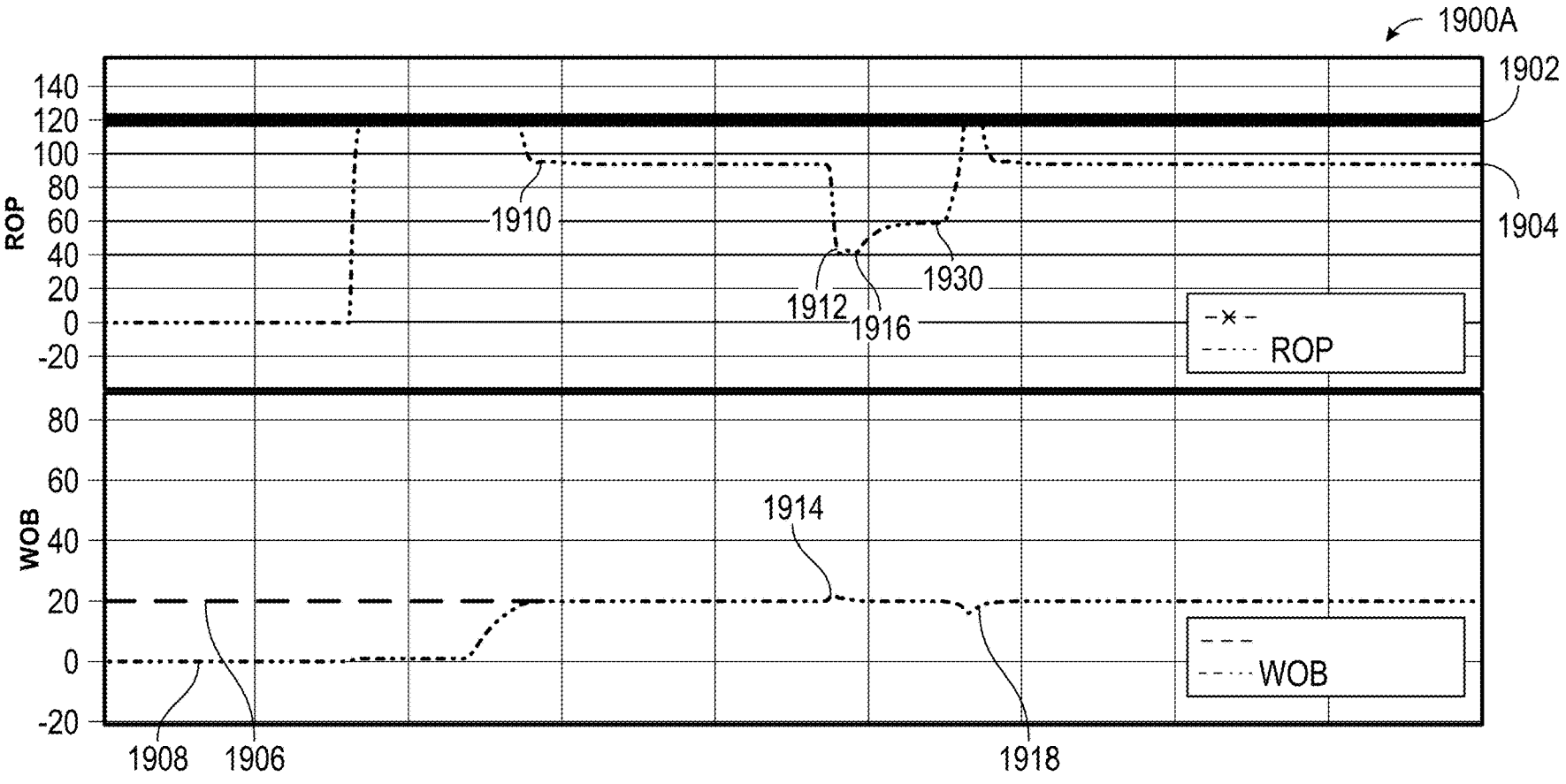
FIG. 19A illustrates a graph showing simulation results.

FIG. 19A illustrates a graph 1900A showing simulation results. In graph 1900A, an ROP set point 1902 is shown. Graph 1900A shows simulated ROP 1904. Graph 1900A further shows WOB set point 1906 and simulated WOB 1908. In FIG. 19A, the process shows an increase in ROP to the ROP set point 1902 (e.g., 120 feet per minute). As the drill bit encounters the formation, the ROP can decrease from the set point 1902 to a steady state ROP.

At 1912 a tool joint passes through the rotating head. The passing of the tool joint through the rotating head can result in an increase in observed WOB at 1914 during the tool joint passing event and a resulting drop in ROP at 1912. The ROP controller can detect the tool joint passing event and generate an ROP adjustment signal to increase ROP at 1916. As the tool joint passing event is cleared at 1918, the ROP will increase at 1930 and will return to a steady state value. The ROP adjustment signal and corresponding increase in ROP can result in an overall improved ROP for the drill period.

Figure 19B:
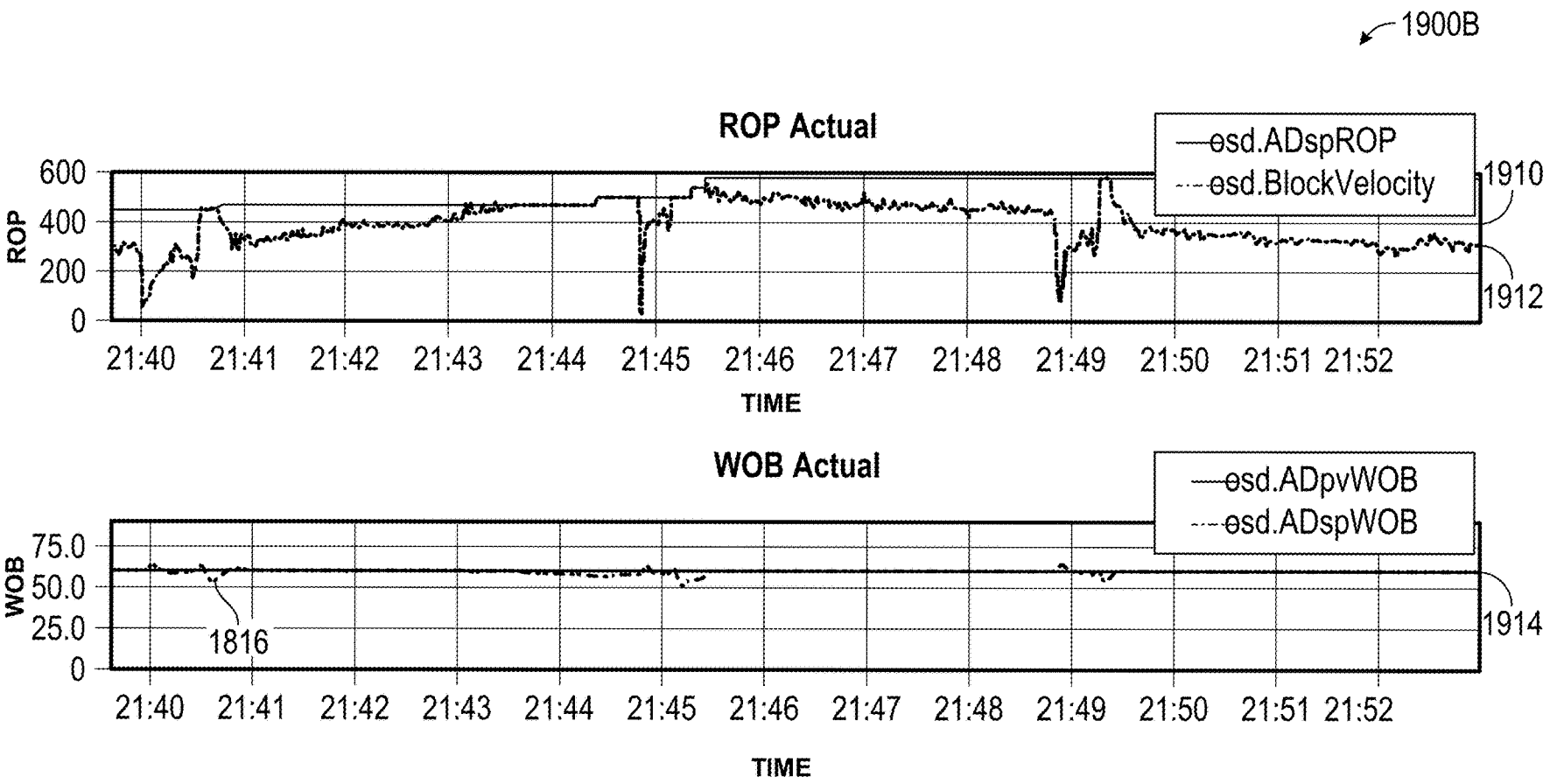
FIG. 19B illustrates a graph showing actual data for ROP and surface weight on bit.

FIG. 19B illustrates graph 1900B showing data for actual ROP 1910 and block velocity 1912. Graph 1900B shows data for actual ROP 1910, block velocity 1912, WOB set point 1914 and actual WOB 1916. In both FIGS. 19A and 19B, the x-axis represents time. In FIG. 19A, the y-axis represents ROP in feet/hour. In FIG. 19B, the y-axis represents thousand pounds (Klbs). The values from a test well site show similar improved results of overall ROP to the simulation results as shown in FIG. 19A.

FIGS. 20-25 illustrate details of the simulation using the control system including the physical tooljoint model, according to various embodiments.

Figure 20:
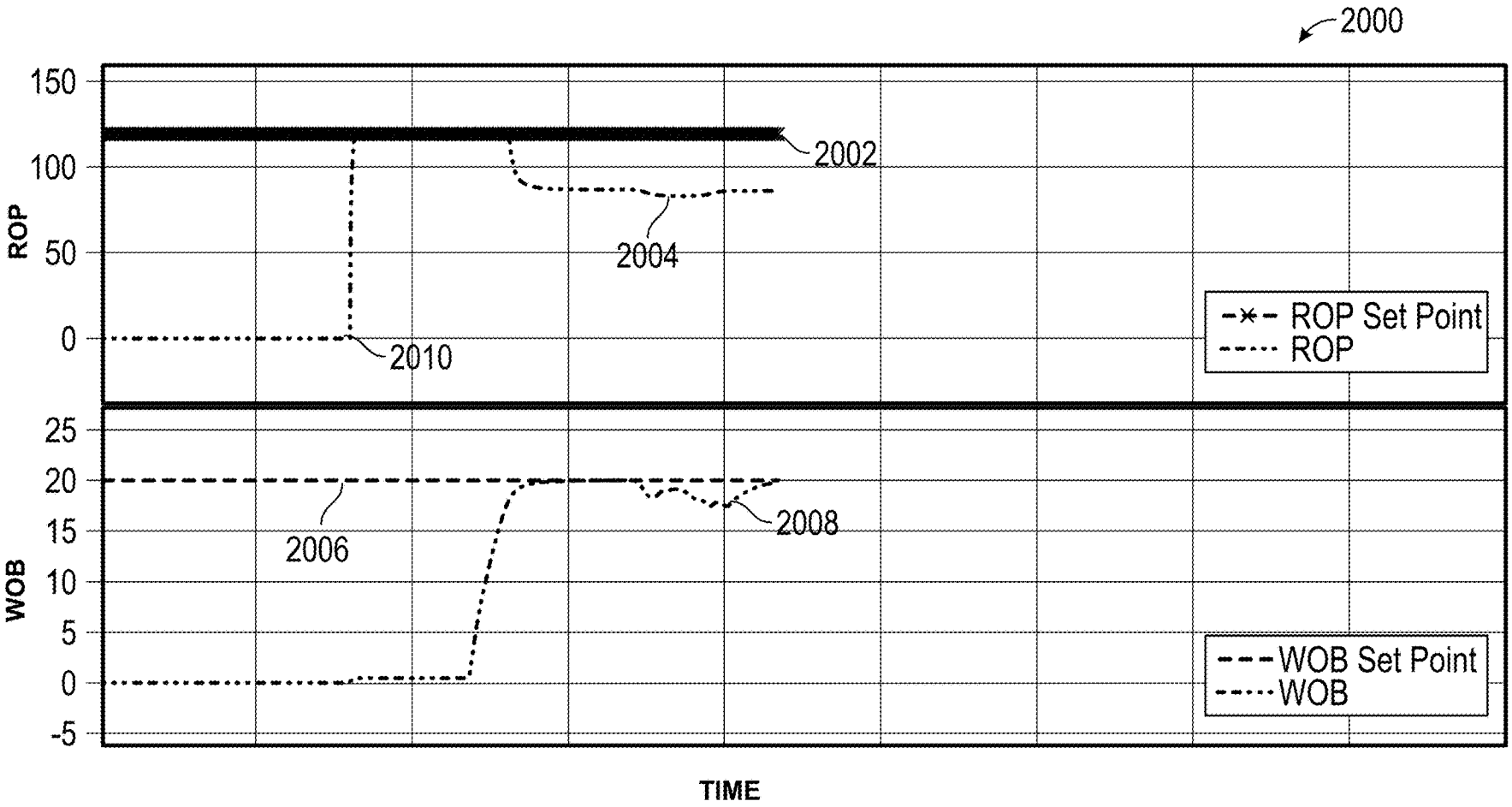
FIGS. 20-25 illustrate details of the simulation using the control system including the physical tool joint model, according to various embodiments.

FIG. 20 illustrates that a constant ROP is achieved when running the physical tooljoint model with the correction, according to various embodiments. In graph 2000, an ROP set point 2002 is shown. Graph 2000 shows simulated ROP 2004. Graph 2000 further shows WOB set point 2006 and simulated WOB 2008. At point 2010, the process shows an increase in ROP to the ROP set point 2002 (e.g., 120 feet per minute). As the drill bit encounters the formation, the ROP can decrease from the set point 2002 to a steady state ROP 2004.

Figure 21:
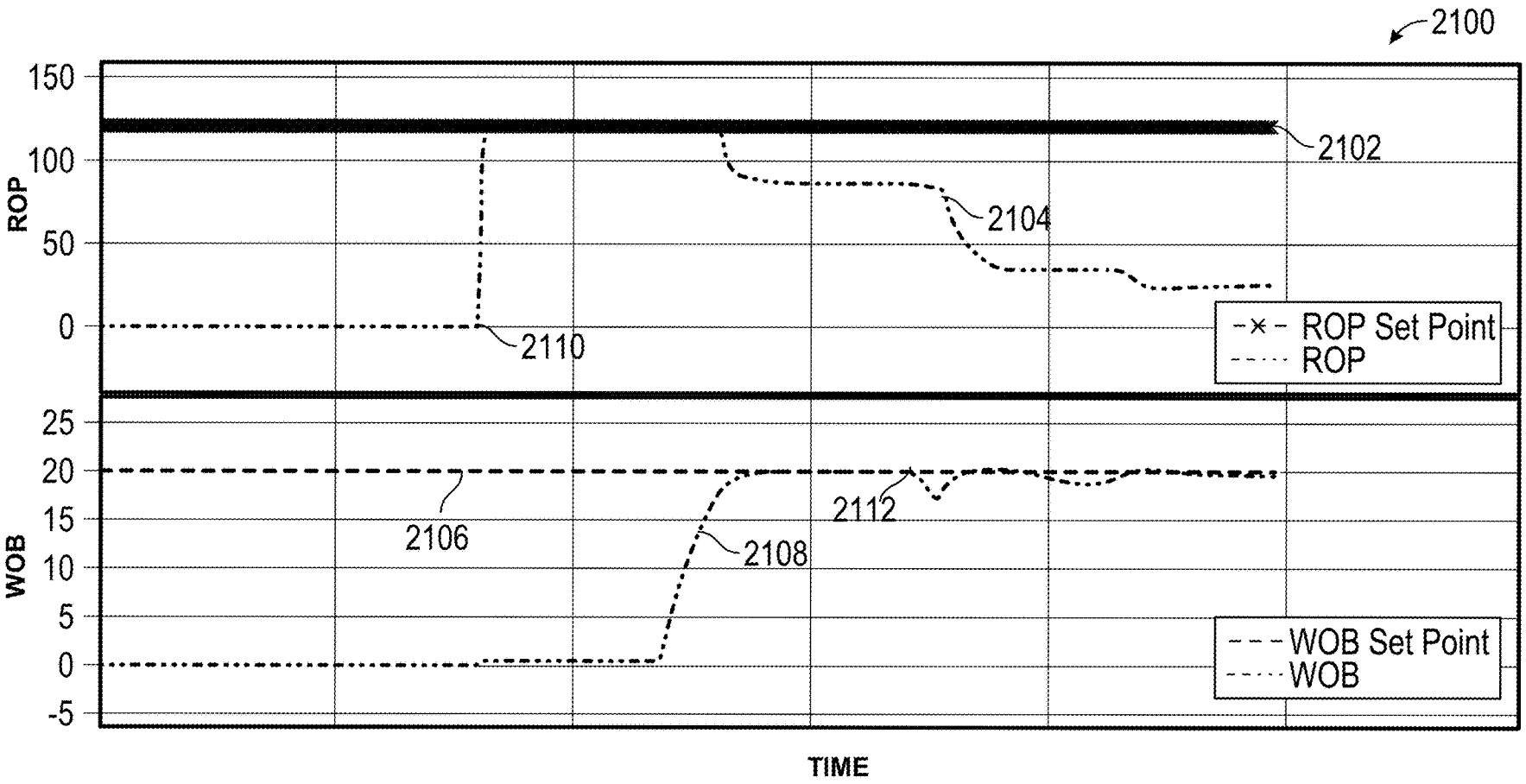

FIG. 21 illustrates that the physical tooljoint model (e.g., the simulation) appropriately reacts when rock hardness increases, at point 2112, during tooljoint passing, according to various embodiments. In graph 2100, an ROP set point 2102 is shown. Graph 2100 shows simulated ROP 2104. Graph 2100 further shows WOB set point 2106 and simulated WOB 2108. At point 2110, the process shows an increase in ROP to the ROP set point 2102 (e.g., 120 feet per minute). As the drill bit encounters the formation, the ROP can decrease from the set point 2102 to a steady state ROP 2104.

Figure 22:
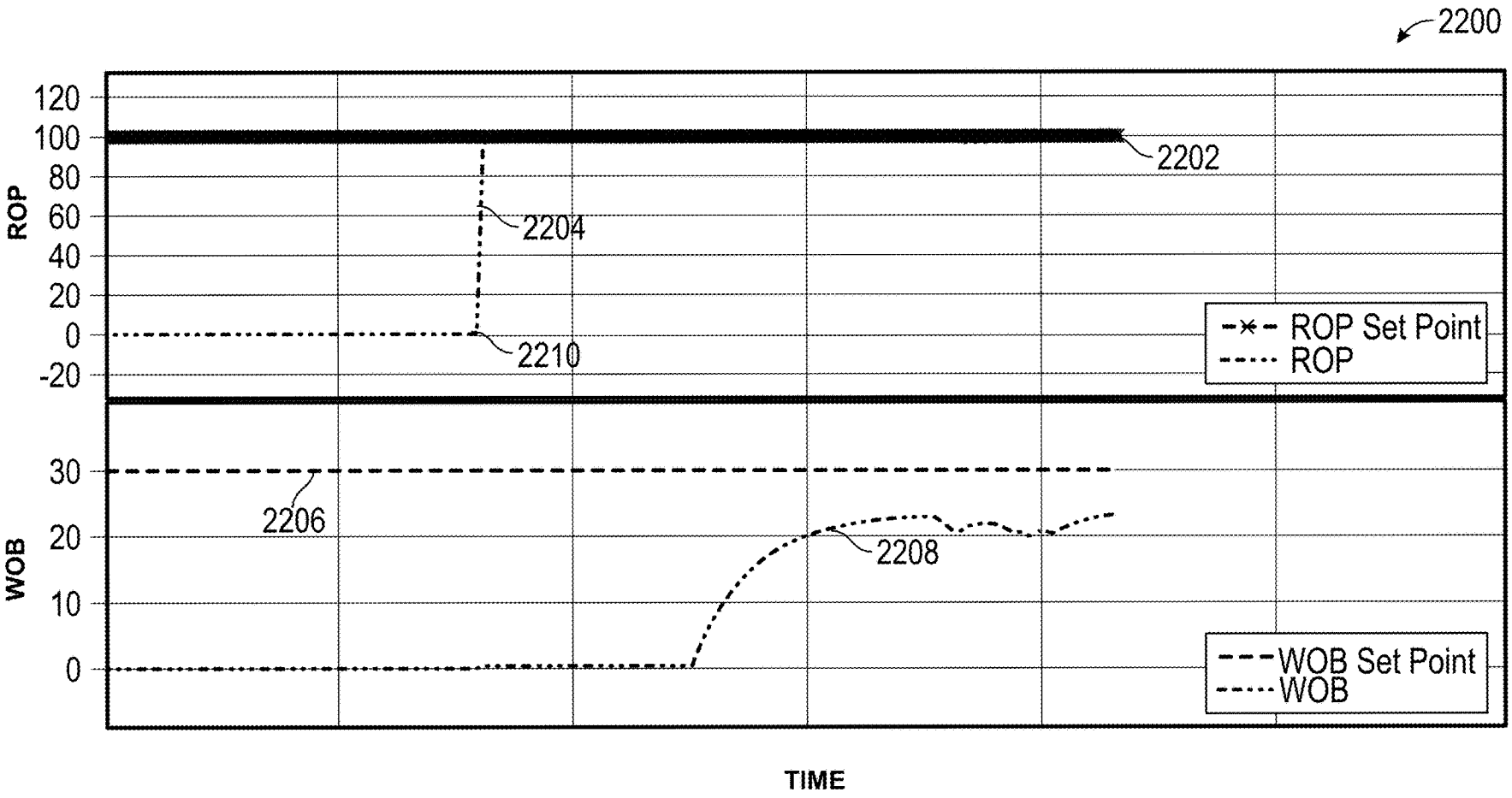

FIG. 22 illustrates that the open loop (ROP regulation) behavior remains the same, according to various embodiments. In graph 2200, an ROP set point 2202 is shown. Graph 2200 shows simulated ROP 2204. Graph 2200 further shows WOB set point 2206 and simulated WOB 2208. At point 2210, the process shows an increase in ROP to the ROP set point 2202 (e.g., 120 feet per minute).

Figure 23:
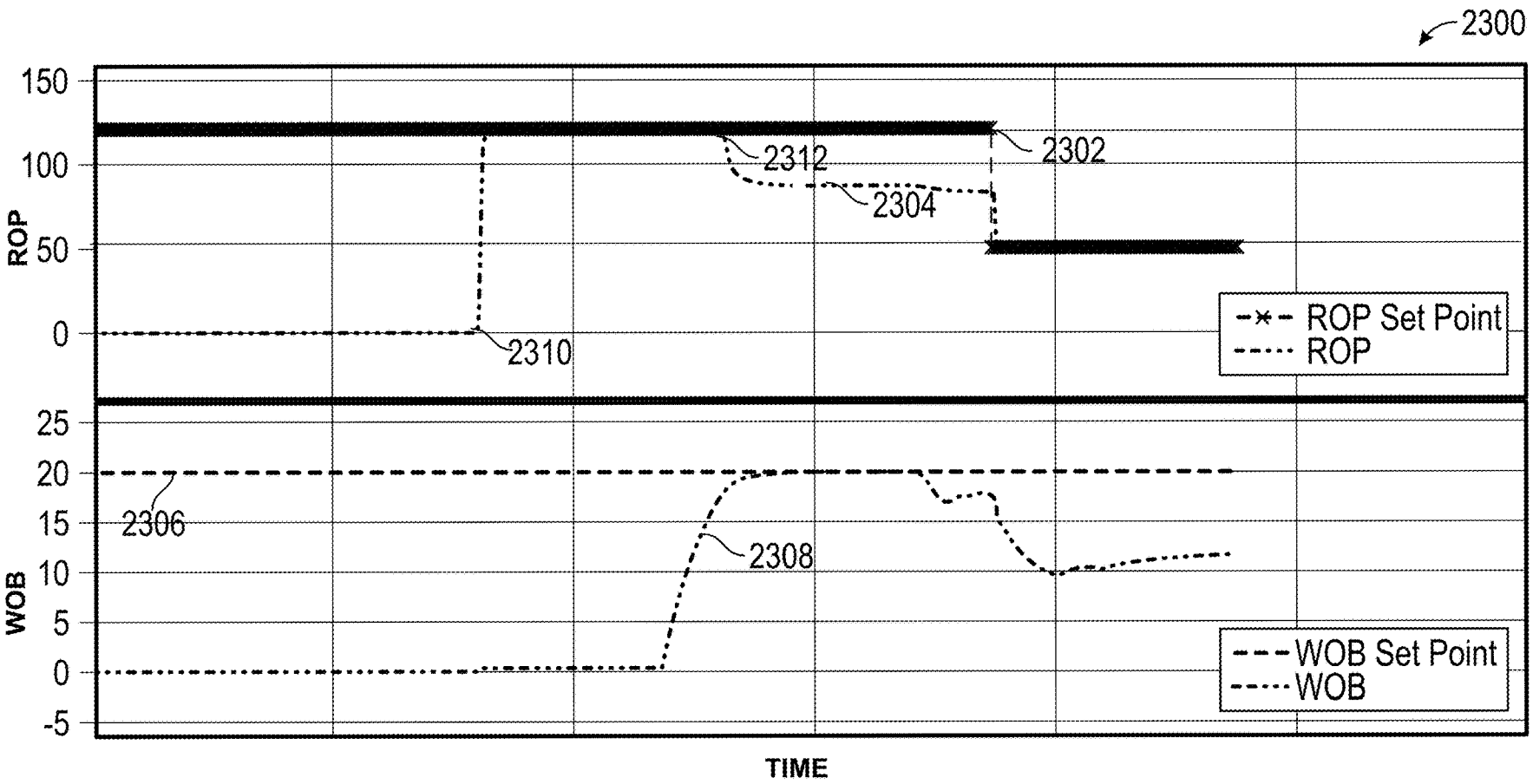

FIG. 23 illustrates that the physical tooljoint model (e.g., the simulation) appropriately reacts, at point 2312, when set point drop moves WOB-regulation to open-loop, according to various embodiments. In graph 2300, an ROP set point 2302 is shown. Graph 2300 shows simulated ROP 2304. Graph 2300 further shows WOB set point 2306 and simulated WOB 2308. At point 2310, the process shows an increase in ROP to the ROP set point 2302 (e.g., 120 feet per minute).

Figure 24:
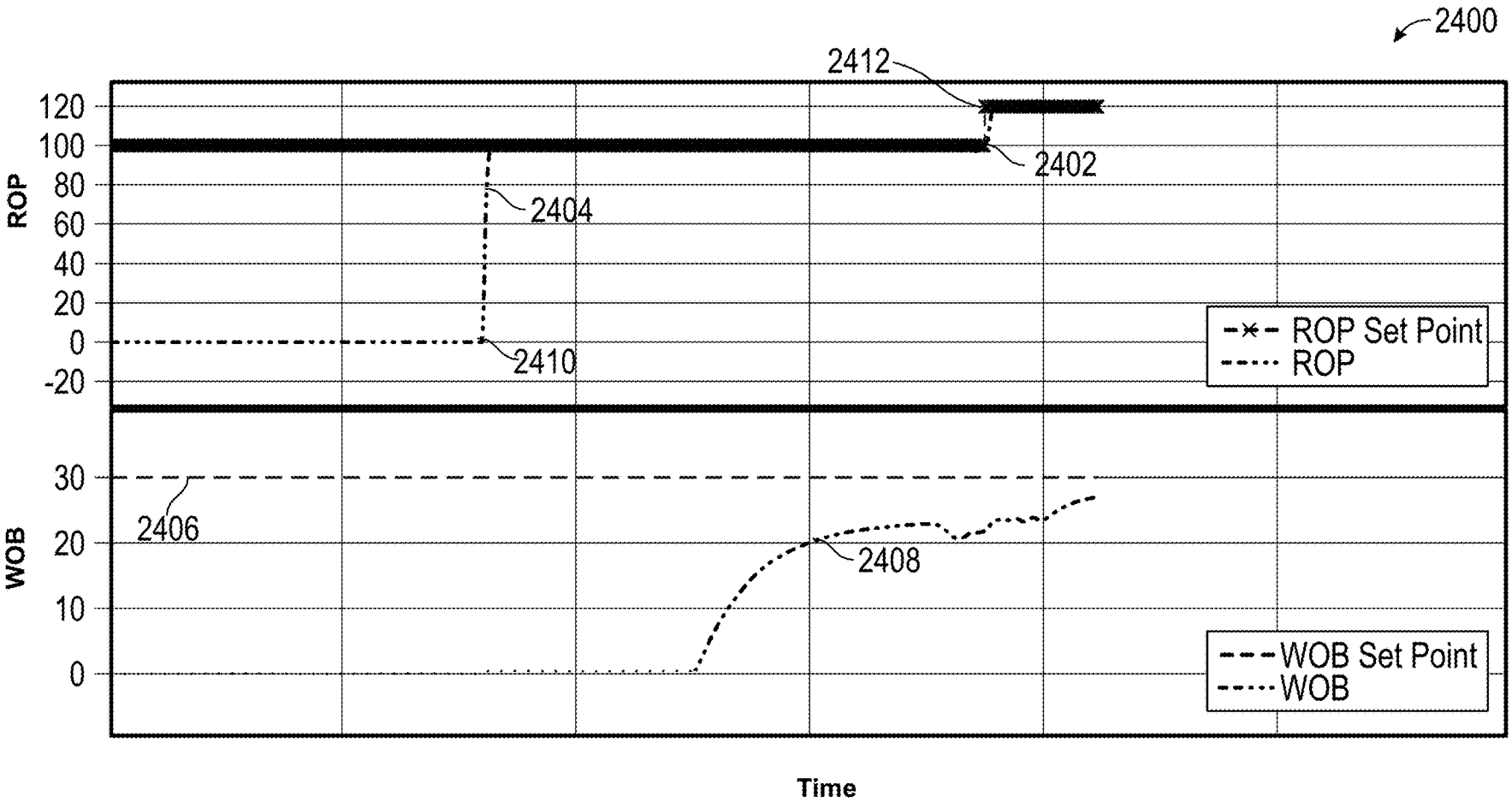

FIG. 24 illustrates that when in open-loop mode, the ROP set point is increased during event, at point 2412, according to various embodiments. In graph 2400, an ROP set point 2402 is shown. Graph 2400 shows simulated ROP 2404. Graph 2400 further shows WOB set point 2406 and simulated WOB 2408. At point 2410, the process shows an increase in ROP to the ROP set point 2402 (e.g., 120 feet per minute). As can be seen in graph 2400, the WOB 2408 remains stable by increasing the ROP set point.

Figure 25:
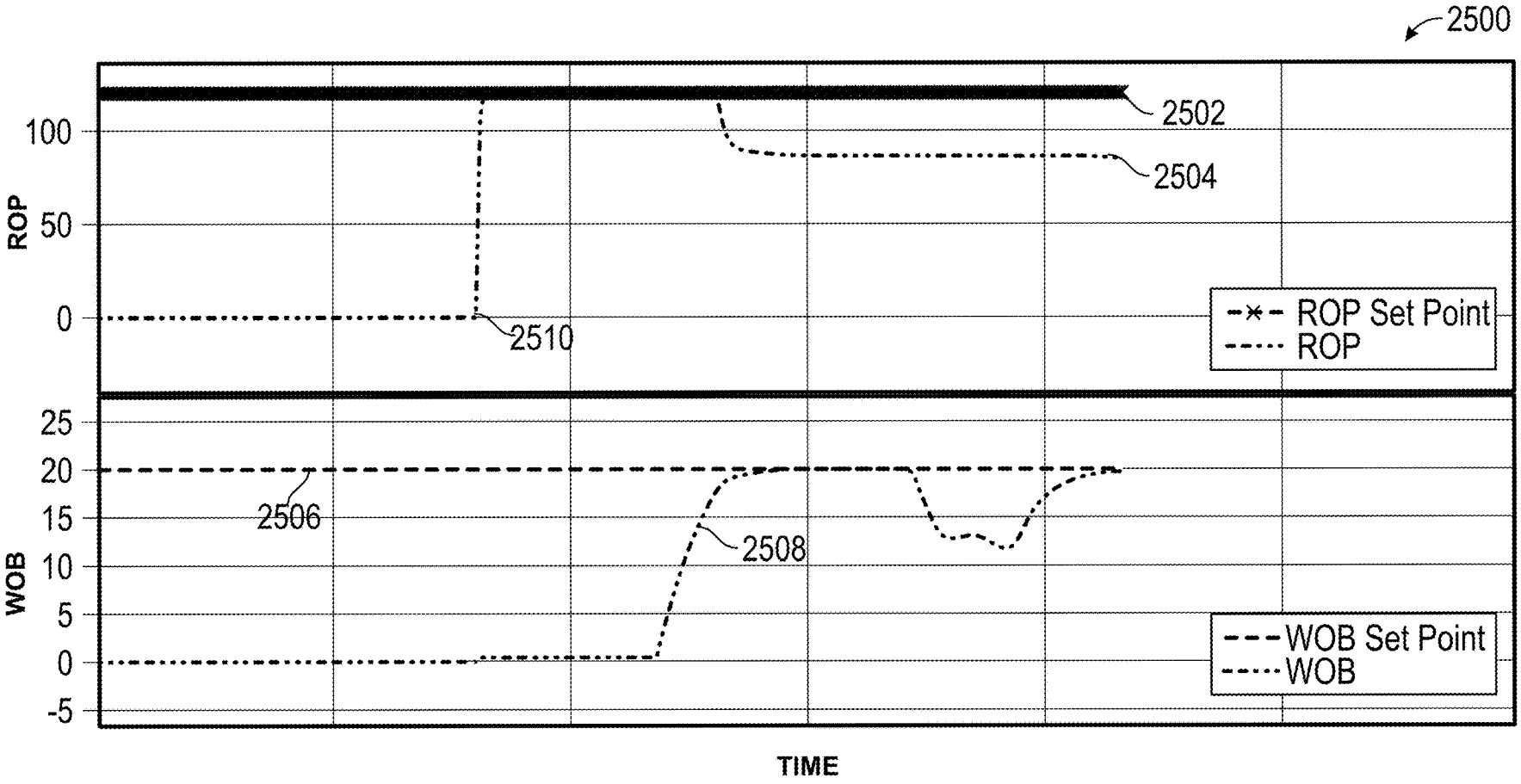

FIG. 25 illustrates an exemplary simulation case where calibration is off, and the correction is applied while not physically passing tooljoint. In this exemplary simulation, the ROP does not increase, thereby confirming the accuracy of the control system. In graph 2500, an ROP set point 2502 is shown. Graph 2500 shows simulated ROP 2504. Graph 2500 further shows WOB set point 2506 and simulated WOB 2508. At point 2510, the process shows an increase in ROP to the ROP set point 2502 (e.g., 120 feet per minute).

Using the physical model as the baseline, and then running with correction, the absement between ROP for the two was computed for each tooljoint passing event, in both rotating and sliding modes. Absement is a measure of for how long the ROP was reduced by how much. It is expressed in units of feet/hour*seconds. By extrapolating based on average ROP, as well as how often the tooljoint passing events are expected, it was determined that in an exemplary case (regulating on WOB, ROP limit not high above current ROP), sliding efficiency can be improved by 0.8%, and rotating efficiency can be improved by 2.4%.

As described above, the control system may receive as inputs the generated force profile and a current position of the tooljoint (e.g., as measured by a sensor). The control system then outputs an adjustment to the ROP. The adjustment to the ROP may be implemented by manipulating one or more other parameters such as bit speed, mud pressure, WOB, etc. Embodiments allow to differentiate between a resistance caused by the rotating head 1110 when a tooljoint passes therethrough from an actual resistance caused by the rock formation that is being drilled.

According to various embodiments, the control system described herein may be combined with a computer vision system that identifies and determines an actual location of the tooljoint, including the tooljoint entering the rotating head, and/or the tooljoint exiting the rotating head, for improved accuracy. The output(s) of one or more such computer vision systems may be combined with information from other sensors and fed to the control system (such as controller 1300) to more accurately determine and control the effects of the tooljoints during drilling operations to maximize ROP. Examples of such computer vision systems that may be coupled to or part of the control system include computer vision systems such as those described in U.S. Published Patent Application No. U.S. 2016/0130889 A1, published on May 12, 2016; U.S. Pat. No. 10,982,950, issued on Apr. 20, 2021; and U.S. Pat. No. 10,957,177, issued on Mar. 23, 2021, each of which is hereby incorporated by reference as if fully set forth herein.

Figure 26:
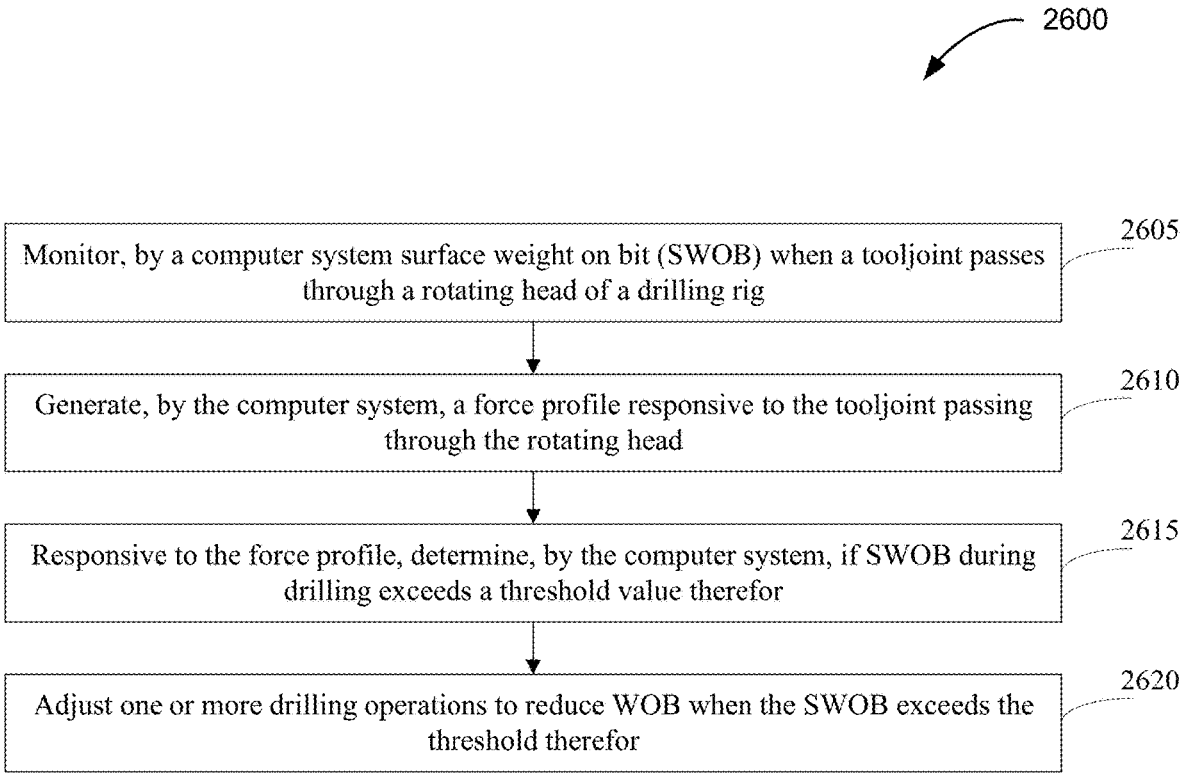
FIG. 26 illustrates an exemplary flowchart for a second exemplary method of controlling weight on bit according to an embodiment of the disclosure.

FIG. 26 illustrates steps associated with process 2600 for determining an ROP force during tool joint passing event in accordance with an embodiment of the disclosure. In some implementations, one or more of the process blocks of FIG. 26 may be performed by the ROP controller 1300. In some implementations, one or more process blocks of FIG. 26 may be performed by another device, or a group of devices separate from or including the ROP controller 1300. Additionally, or alternatively, one or more process blocks of FIG. 26 may be performed by one or more components of ROP controller 1300, such as processor 1302, memory/media 1310, input device 1308, output device 1309, computer instructions 1324, a display 1305, and a bus 1302.

At block 2605, process 2600 may include monitoring, by a computer system surface weight on bit (SWOB) when a tooljoint passes through a rotating head of a drilling rig. For example, device may monitor, by a computer system surface weight on bit (SWOB) when a tooljoint passes through a rotating head of a drilling rig, as described above.

At block 2610, process 2600 may include generating, by the computer system, a force profile responsive to the tooljoint passing through the rotating head. For example, a controller may generate, by the computer system, a force profile responsive to the tooljoint passing through the rotating head, as described above.

At block 2615, process 2600 may include responsive to the force profile, determining, by the computer system, if SWOB during drilling exceeds a threshold value therefor. For example, a controller may responsive to the force profile, determine, by the computer system, if SWOB during drilling exceeds a threshold value therefor, as described above.

At block 2620, process 2600 may include adjusting one or more drilling operations to reduce WOB when the SWOB exceeds the threshold therefor. For example, a controller may adjust one or more drilling operations to reduce WOB when the SWOB exceeds the threshold therefor, as described above.

Process 2600 may include additional implementations, such as any single implementation or any combination of implementations described below and/or in connection with one or more other processes described elsewhere herein. A first implementation, the process 2600 may include the step of continuing drilling operations when the SWOB does not exceed the threshold therefor.

In a second implementation, alone or in combination with the first implementation, the force profile may include an average force profile expressed as SWOB relative to a unit length.

In a third implementation, alone or in combination with the first and second implementation, the force profile may include an average value of a plurality of SWOB values. The plurality of SWOB values may include SWOB values associated with a plurality of tooljoints passing one of a plurality of rotating heads of a drilling rig obtained from a previously drilled well.

A fourth implementation, alone or in combination with one or more of the first through third implementations, the process 2600 may include the step of monitoring, by the computer system, a block height value associated with each of the SWOB values.

A fifth implementation, alone or in combination with one or more of the first through fourth implementations, the process 2600 may further include determining, by a computer system, whether a block height or block height range is associated with one or more feature points of the force profile. The process 2600 may include determining, by a computer system and responsive to the block height or block height range, an actual hook load value for the drill string.

A sixth implementation, alone or in combination with one or more of the first through fifth implementations, the process 2600 may include using the actual hook load value to control one or more drilling operations.

It should be noted that while FIG. 26 shows example blocks of process 2600, in some implementations, process 2600 may include additional blocks, fewer blocks, different blocks, or differently arranged blocks than those depicted in FIG. 26. Additionally, or alternatively, two or more of the blocks of process 2600 may be performed in parallel.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

What is claimed is:

1. A method for drilling, the method comprising:

determining, using a sensor, a surface weight on bit (SWOB) during drilling of a wellbore;

tracking, by a computer system, when a joint passes through a first end of a rotating head of a drilling rig, wherein the joint comprises a connection between two drill pipes, a connection between a pipe and a tool, or a connection between two tools;

generating, by the computer system, a force profile responsive to the joint passing through the first end of the rotating head;

responsive to the force profile, determining, by the computer system, that the SWOB when the joint passes through the first end of the rotating head during drilling exceeds a threshold value therefor;

responsive to determining that the SWOB when the joint passes through the first end of the rotating head during drilling exceeds the threshold value, adjusting, by the computer system in real-time during drilling, one or more drilling operations to reduce WOB, and drilling the wellbore, using the adjusted one or more drilling operations, as the joint continues to pass through the rotating head and exits a second end of the rotating head.

2. The method according to claim 1, wherein the force profile comprises an average force profile expressed as SWOB relative to a unit length.

3. The method according to claim 2, wherein the force profile comprises an average value of a plurality of SWOB values, wherein the plurality of SWOB values comprise SWOB values associated with a plurality of joints passing one of a plurality of rotating heads of a drilling rig obtained from a previously drilled well.

4. The method according to claim 3, further comprising monitoring, by the computer system, a block height value associated with each of the SWOB values.

5. The method according to claim 4, further comprising:

determining, by a computer system, whether a block height or block height range is associated with one or more feature points of the force profile; and determining, by a computer system and responsive to the block height or block height range, an actual hook load value for the drill string.

6. The method according to claim 5, further comprising using the actual hook load value to control one or more drilling operations.

7. The method according to claim 1, further comprising: determining, during drilling of the wellbore, that the SWOB is a transient WOB increase that does not exceed the threshold.

8. The method according to claim 7, further comprising: maintaining a rate of penetration when the increase in SWOB is determined to be a transient WOB increase.

9. The method according to claim 1, wherein the force profile comprises an average hook load value.

10. The method according to claim 1, wherein the threshold value is determined responsive to the force profile.

11. The method according to claim 1, further comprising: responsive to the force profile, determining whether one or more elevator positions correspond to one or more hook load value increases.

12. The method according to claim 11, further comprising:

applying a force correction to the hook load value when a hook load value increase corresponds to the one or more elevator positions.

13. A non-transitory computer-readable storage medium comprising computer-executable instructions that, when executed by one or more processors, cause the one or more processors to perform operations comprising:

receiving, from a sensor, sensor data related to surface weight on bit (SWOB) during drilling of a wellbore;

determining, by a computer system, when a joint passes through a first end of a rotating head of a drilling rig;

generating, by the computer system, a force profile responsive to the joint passing through a first end of the rotating head;

responsive to the force profile, comparing, by the computer system, the SWOB when the joint passes through the first end of the rotating head of the drilling string to a threshold value; and responsive to determining that the SWOB exceeds the threshold value, sending, by the computer system, a control signal to a drilling control system coupled to the drilling rig to drill the wellbore with the one or more adjusted drilling operations in real-time during drilling as the joint continues to pass through the rotating head and exits a second end of the rotating head to reduce WOB.

14. The non-transitory computer-readable storage medium of claim 13, wherein the force profile comprises an average force profile expressed as SWOB relative to a unit length.

15. The non-transitory computer-readable storage medium of claim 14, wherein the force profile comprises an average value of a plurality of SWOB values, wherein the plurality of SWOB values comprise SWOB values associated with a plurality of joints passing a first end of one of a plurality of rotating heads of a drilling rig obtained from a previously drilled well.

16. The non-transitory computer-readable storage medium of claim 15, further comprising instructions for performing the step of monitoring, by the computer system, a block height value associated with each of the SWOB values.

* * * * *